US011117704B2

(12) United States Patent
Chen et al.

(10) Patent No.: US 11,117,704 B2
(45) Date of Patent: Sep. 14, 2021

(54) BEVERAGE BOX

(71) Applicant: Pratt Corrugated Holdings, Inc., Conyers, GA (US)

(72) Inventors: Shifeng Chen, Newport News, VA (US); Greg Sollie, Sharpsburg, GA (US); Jamie Waltermire, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 16/903,440

(22) Filed: Jun. 17, 2020

(65) Prior Publication Data

US 2021/0139189 A1 May 13, 2021

Related U.S. Application Data

(60) Provisional application No. 62/933,726, filed on Nov. 11, 2019.

(51) Int. Cl.
*B65D 5/49* (2006.01)
*B65D 1/24* (2006.01)
(Continued)

(52) U.S. Cl.
CPC ..... *B65D 5/48028* (2013.01); *B65D 1/243* (2013.01); *B65D 5/4279* (2013.01);
(Continued)

(58) Field of Classification Search
CPC .. B65D 5/48028; B65D 1/243; B65D 5/4279; B65D 5/6635; B65D 5/6655;
(Continued)

(56) References Cited

U.S. PATENT DOCUMENTS 3,194,480 A 7/1965 Maindron et al.
3,198,379 A * 8/1965 Creelman ..... B65D 71/0077 206/165
(Continued)

FOREIGN PATENT DOCUMENTS

GB 2342637 4/2000

OTHER PUBLICATIONS

Chen, Shifeng; Requirement for Restriction/Election for U.S. Appl. No. 16/903,460, filed Jun. 17, 2020, dated Jan. 22, 2021, 5 pgs.
Chen, Shifeng; Non-Final Office Action for U.S. Appl. No. 16/903,460, filed Jun. 17, 2020, dated Jan. 12, 2021, 12 pgs.

*Primary Examiner* — Christopher R Demeree
(74) *Attorney, Agent, or Firm* — Taylor English Duma LLP

(57) ABSTRACT

A box includes a container portion, the container portion defining a top end and a bottom end, the container portion defining a cavity; a telescoping portion attached to the top end of the container portion, the telescoping portion selectively reconfigurable about and between a retracted configuration and an extended configuration, a portion of the telescoping portion being positioned within the cavity in the retracted configuration, the telescoping portion disposed external to the cavity in the extended configuration; and a dividing portion disposed within the cavity, the dividing portion defining a plurality of cells within the cavity.

19 Claims, 18 Drawing Sheets

(51) Int. Cl.
*B65D 5/42* (2006.01)
*B65D 5/66* (2006.01)

(52) U.S. Cl.
CPC ..... *B65D 5/6635* (2013.01); *B65D 5/6655* (2013.01); *B65D 2501/2435* (2013.01); *B65D 2501/24184* (2013.01); *B65D 2501/24216* (2013.01); *B65D 2501/24528* (2013.01); *B65D 2501/24541* (2013.01)

(58) Field of Classification Search
CPC ..... B65D 2501/24184; B65D 2501/24216; B65D 2501/2435; B65D 2501/24541; B65D 2571/0029; B65D 2571/00388; B65D 5/48048; B65D 2571/00512
USPC .... 229/120.29, 117.01, 117.14, 103, 120.11, 229/120.18, 120.24; 206/162, 180, 170, 206/193, 174
See application file for complete search history.

(56) References Cited

U.S. PATENT DOCUMENTS

| | | | | |
|---|---|---|---|---|
| 3,349,986 | A | 10/1967 | Chapman et al. | |
| 3,827,550 | A | 8/1974 | Arneson | |
| 4,318,470 | A * | 3/1982 | Montealegre ..... | B65D 5/3621 206/180 |
| 4,756,469 | A * | 7/1988 | Hansen ..... | B65D 5/48004 229/120.25 |
| 6,755,324 | B2 | 6/2004 | Geshay | |
| 8,490,785 | B2 | 7/2013 | Brand | |
| 9,415,914 | B2 | 8/2016 | Holley, Jr. | |
| 9,540,132 | B1 | 1/2017 | Lee | |
| 10,301,090 | B2 | 5/2019 | Holley, Jr. | |
| 2010/0147932 | A1 * | 6/2010 | Brand ..... | B65D 71/0055 229/117.01 |
| 2014/0166519 | A1 | 6/2014 | Alexander | |
| 2019/0055071 | A1 | 2/2019 | Hayter et al. | |

* cited by examiner

BEVERAGE BOX

REFERENCE TO RELATED APPLICATION

This application claims priority to U.S. Provisional Application No. 62/933,726, filed Nov. 11, 2019, which is hereby specifically incorporated by reference herein in its entirety.

TECHNICAL FIELD

This disclosure relates to packaging. Specifically, this disclosure relates to packaging for beverage containers.

BACKGROUND

Beverage distribution often involves the shipment of fragile or breakable vessels, such as glass bottles. Packaging utilized for beverage distribution often divides and individually protects the bottles in separate cells. These separate cells are frequently defined by additional cardboard inserts that must be manufactured as separate components from the box, assembled, and then placed into the box. This assembly process involves numerous separate steps that are time-consuming when performed at the volume of mass production.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a box comprising a container portion, the container portion defining a top end and a bottom end, the container portion defining a cavity; a telescoping portion attached to the top end of the container portion, the telescoping portion selectively reconfigurable about and between a retracted configuration and an extended configuration, a portion of the telescoping portion being positioned within the cavity in the retracted configuration, the telescoping portion disposed external to the cavity in the extended configuration; and a dividing portion disposed within the cavity, the dividing portion defining a plurality of cells within the cavity.

Also disclosed is a box blank comprising a bottom panel; a main panel coupled to the bottom panel by a main hinge; a telescoping panel coupled to the main panel by a top hinge positioned opposite from the main hinge; a side subpanel coupled to the main panel by a side hinge; and a dividing wing coupled to the side subpanel opposite from the side hinge by an inner hinge, the dividing wing configured to be folded about the inner hinge and coupled to the main panel to form a box.

Also disclosed is a method of forming a box from a box blank, the method comprising folding a first dividing wing of the box blank relative to a first side subpanel of the box blank about an inner hinge, the inner hinge coupling the first dividing wing to the first side subpanel, the first side subpanel coupled to a first main panel of the box by a first side hinge, the first main panel coupled to a bottom panel of the box by a first main hinge, the bottom panel coupled to a second main panel of the box by a second main hinge, a second side subpanel coupled to the second main panel by a second side hinge, a second dividing wing coupled to the second side subpanel by a second inner hinge; coupling a first portion of the first dividing wing to the first main panel; folding the second dividing wing relative to the second side subpanel about the second inner hinge; coupling a first portion of the second dividing wing to the second main panel; and coupling the first side subpanel to the second side subpanel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
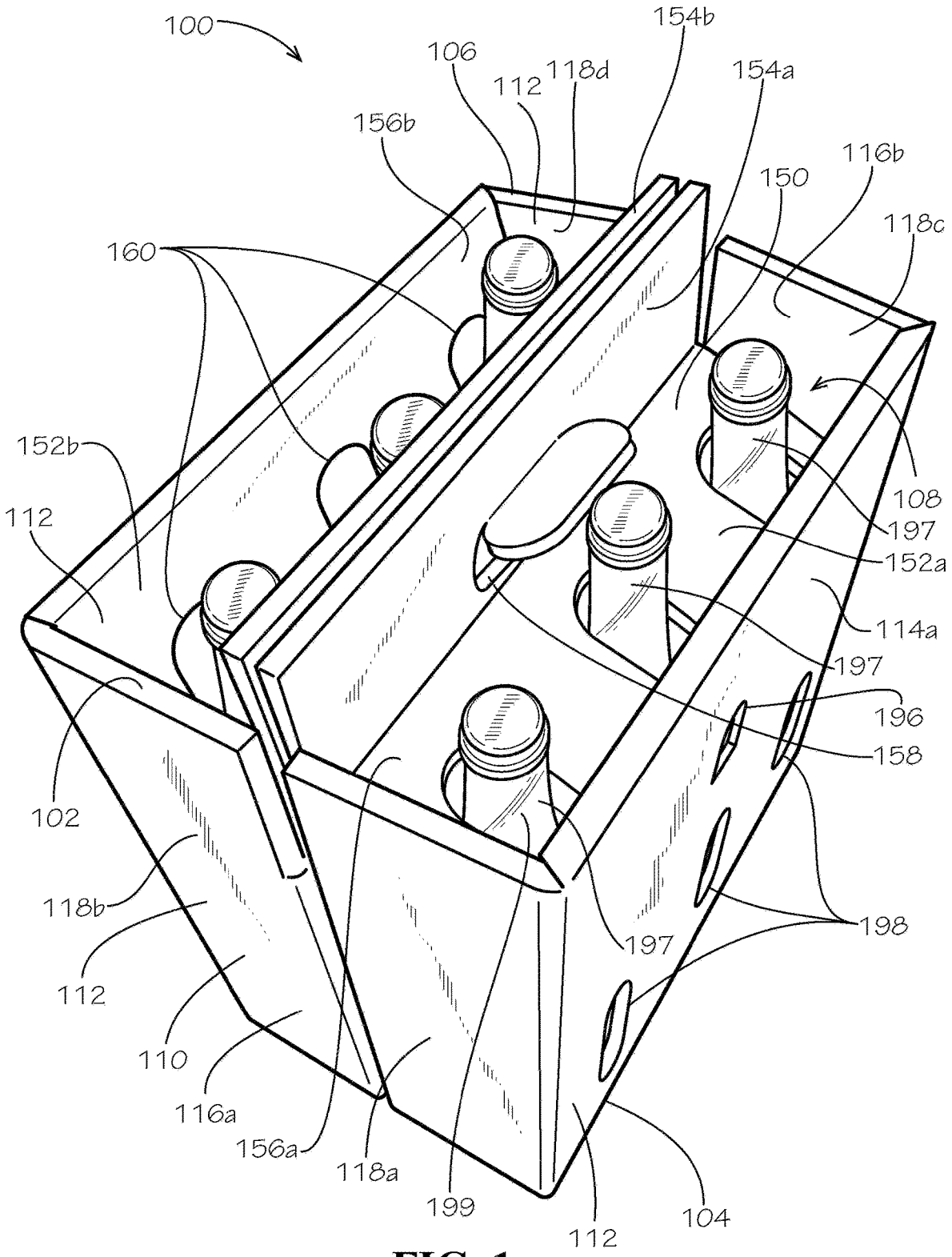
FIG. 1 is a perspective view of a box comprising a container portion, a telescoping portion, and a dividing portion in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a box and associated methods, systems, devices, and various apparatus. The box can comprise a container portion, a telescoping portion, and a dividing portion. It would be understood by one of skill in the art that the disclosed box is described in but a few exemplary aspects among many. No particular terminology or description should be considered limiting on the disclosure or the scope of any claims issuing therefrom.

FIG. 1 is a perspective view of a box 100 in accordance with one aspect of the present disclosure. The box 100 can comprise a container portion 110, a telescoping portion 150, and a dividing portion 480 (shown in FIG. 4).

Figure 2:
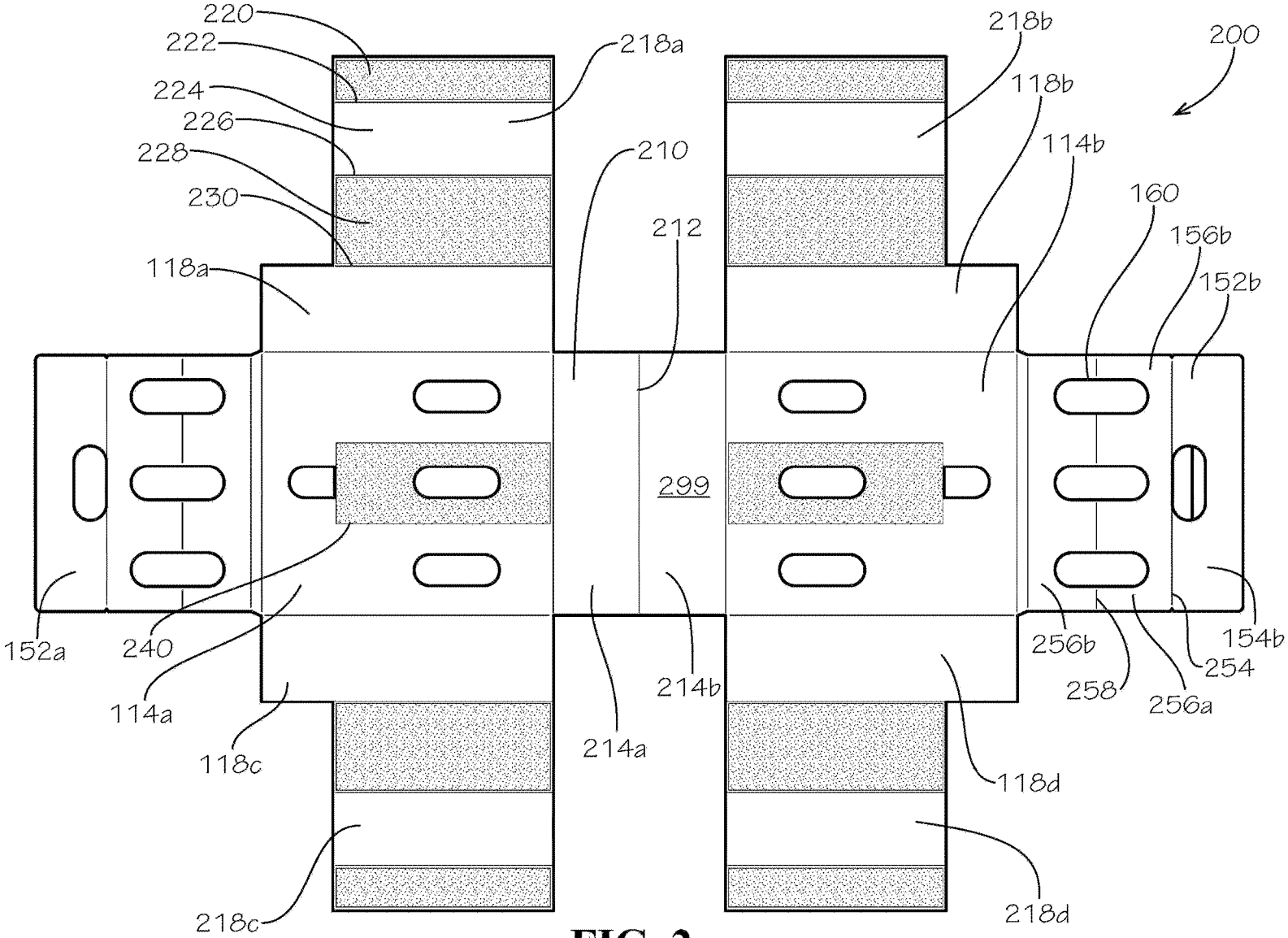
FIG. 2 is a plan view of a box blank that can be assembled to form the box of FIG. 1.

The container portion 110 can comprise a plurality of side walls 112 and a bottom panel 210 (shown in FIG. 2). The plurality of side walls 112 can comprise a pair of opposing main panels 114*a,b* (main panel 114*b* shown in FIG. 2) and a pair of opposing side panels 116*a,b*. Each of the opposing main panels 114*a,b* can be oriented substantially perpendicular to each of the opposing side panels 116*a,b*. Each of the side panels 116*a,b* can be defined by a different pair of side subpanels 118*a,b*, 118*c,d*, respectively. Each pair of side subpanels 118*a,b*, 118*c,d* can be coupled together to define the respective side panel 116*a,b*. Side subpanels 118*a,c* can be hingedly attached at opposite sides of main panel 114*a*, and side subpanels 118*b,d* can be hingedly attached at opposite sides of the main panel 114*b*.

The container portion 110 can define a top end 102 and a bottom end 104, disposed opposite from the top end 102. The top end 102 can define an opening 106 to a cavity 108 defined within the container portion 110 by the plurality of side walls 112 and the bottom panel 210. The bottom panel 210 can be positioned at the bottom end 104, and the bottom panel 210 can be hingedly attached to the main panels 114*a,b*.

The telescoping portion 150 can comprise a pair of telescoping panels 152*a,b*, each hingedly attached to a different one of the main panels 114*a,b* at the top end 102 of the container portion 110. Each telescoping panel 152*a,b* can define a handle portion 154*a,b* and a securing portion 156*a,b*, respectively. In the aspect shown, the telescoping portion 150 is in a retracted configuration, wherein at least a portion of the telescoping portion 150 is positioned below the opening 106 and within the cavity 108. In the present aspect, the securing portions 156*a,b* can be positioned completely within the cavity 108 and the handle portions 154*a,b* can be positioned at least partially within the cavity 108 when the telescoping portion 150 is in the retracted configuration.

Each of the handle portions 154*a,b* can define a hand hole 158, as demonstrated by handle portion 154*a*. Each of the securing portions 156*a,b* can define a plurality of neck slots 160, as demonstrated by securing portion 156*b*. Each of the neck slots 160 can align with a different cell 482 (shown in FIG. 4) defined within the cavity 108 by the dividing portion 480 of the box 100.

In the present aspect, the box 100 can be configured to hold six beverage containers 199, as shown. In the present aspect, the beverage containers 199 can be bottles, such as plastic, aluminum, or glass bottles, for example and without limitation. The box 100 can be configured to hold any type of beverage container 199, including cans, jugs, boxes, jars, bottles, or any other type of vessel. In some aspects, the box 100 can be configured to hold vessels that contain materials other than beverages. For example and without limitation, the box 100 can be configured to hold vessels containing olive oil, vinegar, chemicals, or any other type of liquid, gaseous, or solid matter, or combination thereof. In other aspects, the box 100 can be configured to hold greater or fewer than six vessels or containers.

As depicted, the box 100 can hold six glass wine bottles to represent the beverage containers 199. This depiction is intended to be exemplary rather than limiting. With the telescoping portion 150 positioned in the retracted configuration, necks 197 of the beverage containers 199 can extend through the respective neck slots 160, such as to prevent the beverage containers 199 from tilting side-to-side and striking one another and to prevent the beverage containers 199 from moving vertically upwards and downwards within the respective cells 482 (shown in FIG. 4). In this regard, the retracted configuration of the telescoping portion 150 can be ideally suited for shipping the box 100, particularly in aspects wherein the box 100 can be positioned within an outer box (not shown), either by itself or along with other boxes 100.

Each of the main panels 114*a,b* can define a plurality of viewing ports 198, as demonstrated by main panel 114*a*. In some aspects, one or more of the side panels 116*a,b* can define viewing ports 198 (not shown). The beverage containers 199 can be seen through the viewing ports, such as to identify the contents of the box 100 or the individual beverage containers 199. In some aspects, the viewing ports 198 can be positioned to provide access to bar codes, Quick Response codes, or other indicia defined by the beverage containers 199, so that the beverage containers 199 can be electronically scanned without removing them from the box 100.

As demonstrated by main panel 114*a*, each of the main panels 114*a,b* can define a carrying hole 196. The carrying holes 196 can allow a user to insert one or more fingers, a hand, or a tool into the carrying hole 196 to aid in carrying the box 100.

FIG. 2 is a plan view of a box blank 200 that can be assembled to form the box 100 of FIG. 1. As shown, the bottom panel 210 can be defined by a pair of bottom subpanels 214*a,b*, which can be hingedly attached together by a bottom hinge 212. Each of the bottom subpanels 214*a,b* can be hingedly attached to a different one of the main panels 114*a,b*. The box blank 200 can define a first surface 299 and a second surface 399 (shown in FIG. 3).

As demonstrated by telescoping panel 152*b*, which can be representative of each telescoping panel 152*a,b*, the handle portion 154*b* can be defined by a single subpanel. The handle portion 154*b* can be hingedly attached to the securing portion 156*b* by an upper hinge 254. The securing portion 156*b* can be defined by an upper securing panel 256*a* and a lower securing panel 256*b*, which can be hingedly attached together by a securing hinge 258. As shown, the neck slots 160 can extend across both the upper securing panel 256*a* and the lower securing panel 256*b* in the present aspect.

As shown, a dividing wing 218*a,b,c,d* can be hingedly attached to each of the side subpanels 118*a,b,c,d*, opposite from the adjacent main panel 114*a,b*. Dividing wing 218*a*, which can be representative of each of the dividing wings 218*a,b,c,d*, is labelled to identify an outer panel 220, an outer hinge 222, a middle panel 224, a middle hinge 226, an inner panel 228, and an inner hinge 230. The outer hinge 222 can hingedly attach the outer panel 220 to the middle panel 224. The middle hinge 226 can hingedly attach the middle panel 224 to the inner panel 228. The inner hinge 230 can hingedly attach the inner panel 228 to the respective side subpanel 118*a,b,c,d*, which, for dividing wing 218*a*, can be side subpanel 118*a*.

Main panel 114*a*, which can also be representative of main panel 114*b*, is shown with an adhesive zone 240, denoted by the shaded rectangle on the first surface 299. As shown and further described with respect to FIG. 3 below, the outer panel 220 of each respective dividing wing 218*a,b,c,d* can be folded inwards about the inner hinge 230 and adhered to the respective adhesive zone 240 on the first surface 299 of the respective main panel 114*a,b*. Similarly, the inner panels 228 can be coated with adhesive on the second side 399 (shown in FIG. 3), as indicated by the shaded areas, to couple to one another as discussed below with respect to FIG. 3B.

Figure 3A:
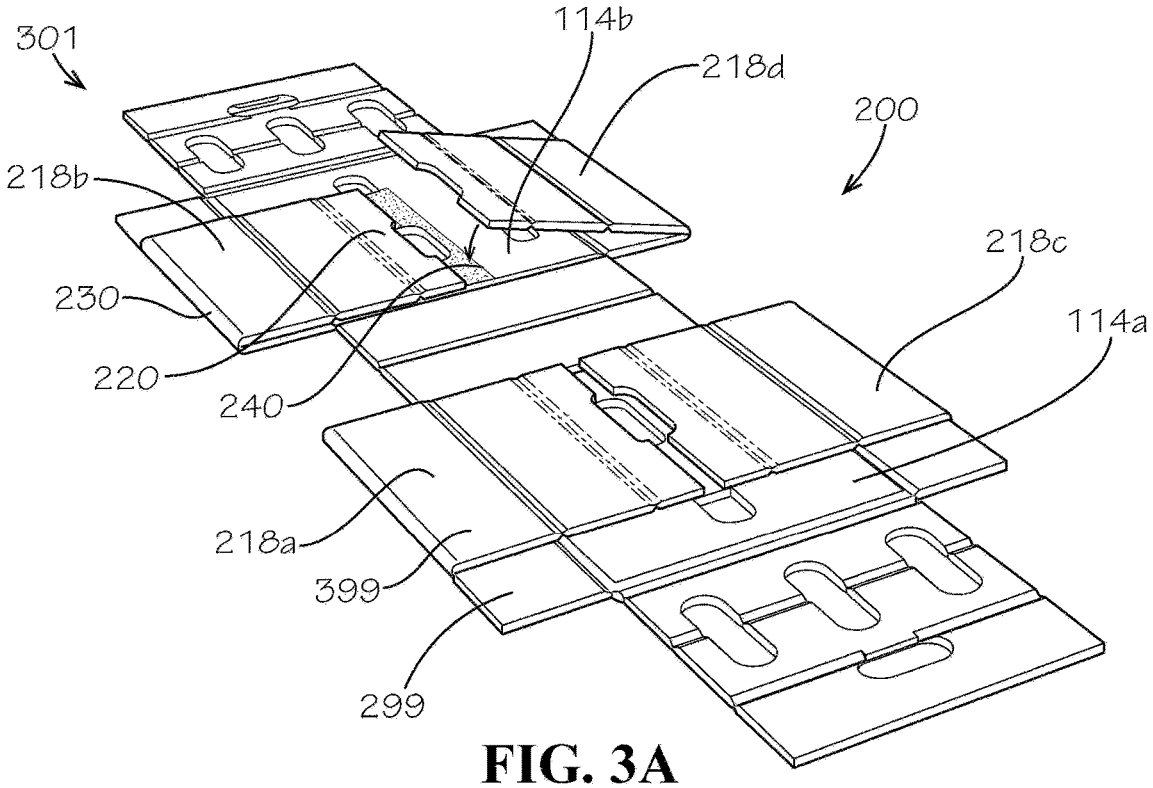
FIG. 3A is a perspective view of the box blank of FIG. 2 demonstrating a first step in assembly the box of FIG. 1.
Figure 3B:
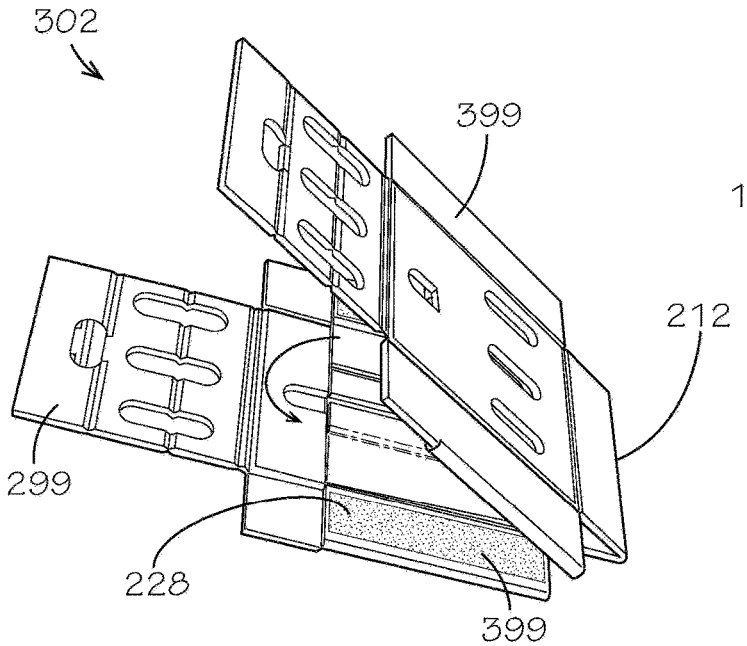
FIG. 3B is a perspective view of the box blank of FIG. 2 demonstrating a second step in assembly the box of FIG. 1.
Figure 3C:
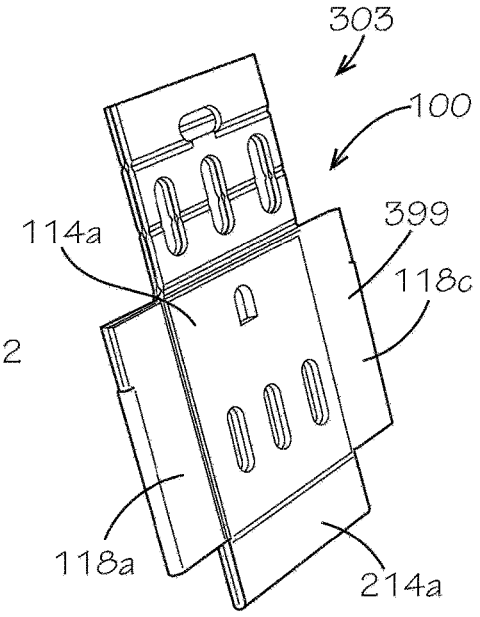
FIG. 3C is a perspective view of the box blank of FIG. 2 demonstrating a third step, which completes assembly of the box of FIG. 1, shown in a collapsed configuration.

FIGS. 3A-C demonstrate a partial assembly sequence of the box 100 of FIG. 1 from the box blank 200 of FIG. 2.

In Step 301, shown in FIG. 3A, each of the dividing wings 218*a,b,c,d* can be folded about the respective inner hinge 230 so that the outer panel 220 can be adhered to first side 299 at the adhesive zone 240 of the respective main panel 114*a,b*, thereby presenting the second side 399 of the dividing wings 281*a,b,c,d*.

In Step 302, shown in FIG. 3B, adhesive can be applied to the inner panels 228 on the second surface 399. The entire box blank 200 can then be folded in half about the bottom hinge 212 so that the inner panels 228 of opposite pairs of dividing wings 218*a,b,c,d* (shown in FIG. 3A) can be adhered together. For example, the inner panel 228 of dividing wing 218*a* can be adhered to the inner panel 228 of dividing wing 218*b*, and the inner panel 228 of dividing wing 218*c* can be adhered to the inner panel 228 of dividing wing 218*d*.

Step 303, shown in FIG. 3C, shows the box 100 in an assembled but collapsed configuration, wherein the main panels 114*a,b* (main panel 114*b* shown in FIG. 2), the side subpanels 118*a,b,c,d* (side subpanels 118*b,d* shown in FIG. 2), and the bottom subpanels 214*a,b* (bottom subpanel 214*b* shown in FIG. 2) are substantially parallel to one another.

Figure 4:
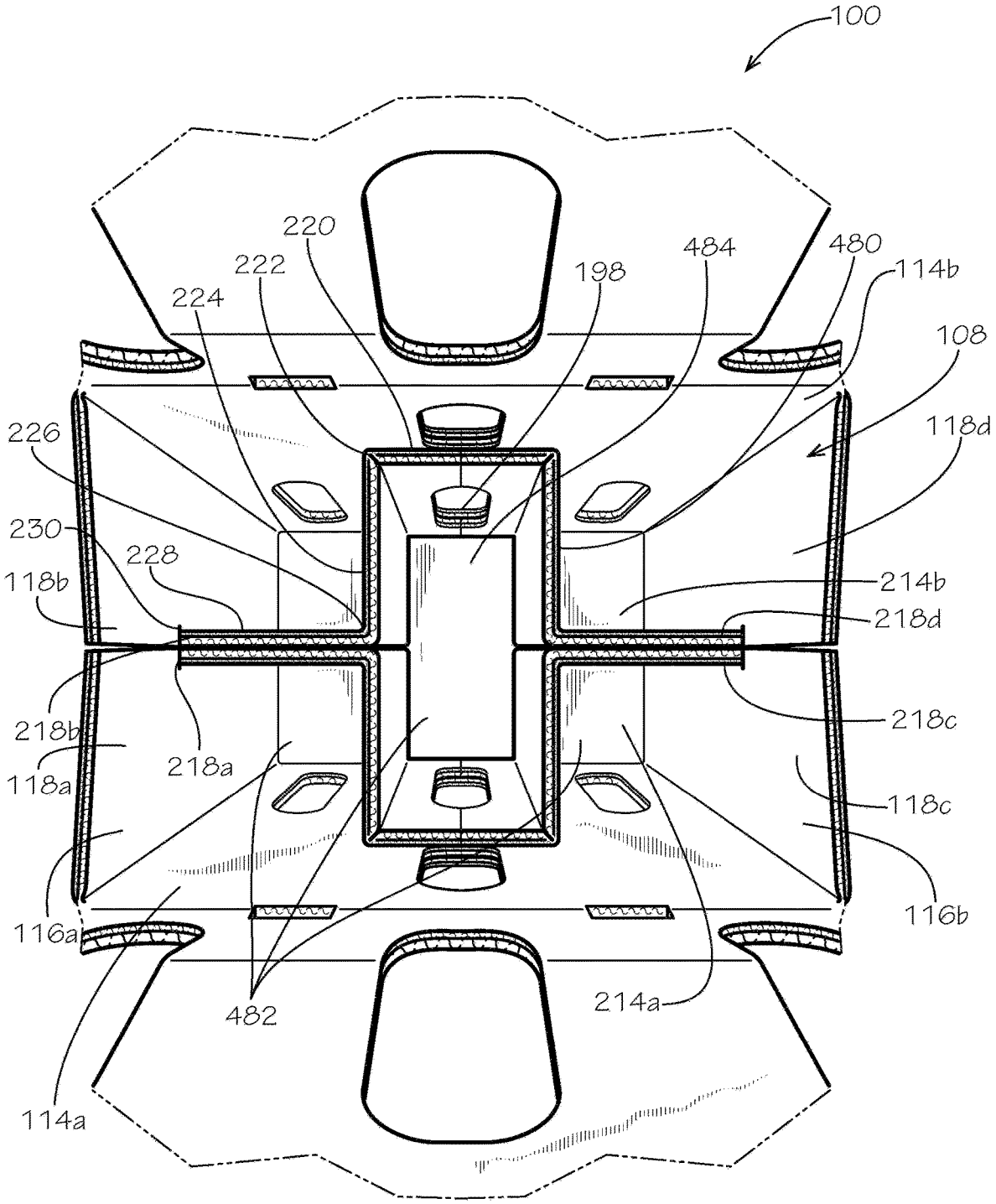
FIG. 4 is a top view of the box of FIG. 1 in an erected configuration.

FIG. 4 is a top view of the box 100 in an erected configuration, wherein the side subpanels 118*a,b,c,d* and bottom subpanels 214*a,b* are substantially perpendicular to the main panels 114*a,b*. As shown, the dividing wings 218*a,b,c,d* can together define the dividing portion 480 of the box 100.

Reconfiguring the box 100 from the collapsed configuration to the erected configuration can articulate the dividing wings 218*a,b,c,d* to define the cells 482. As shown by dividing wing 218*b*, the inner panel 228 can articulate about the inner hinge 230 so that that inner panel 228 can be substantially perpendicular to the adjacent side subpanel 118*b*. As previously described above, the opposing inner panels 228 can be adhered to one another, which couples the opposing side subpanels 118*a,b*, 118*c,d* together to respectively form side panels 116*a,b*.

The middle panels 224 can articulate about the middle hinges 226 so that the middle panels 224 are substantially perpendicular to the inner panels 228 in the erected configuration. The outer panels 220 can be articulated about the outer hinges 222 so that the outer panels 220 can be substantially perpendicular to the middle panels 224, and the outer panels 220 can be adhered to the respective main panels 114*a,b*, as described above. As shown, the outer panels 220 can be cut, or shaped, complementary to the viewing ports 198 so as not to obstruct the viewing ports 198.

In summary, the inner panels 228 and the outer panels 220 can be substantially parallel to the main panels 114*a,b* and substantially perpendicular to the side panels 116*a,b* when the box 100 is in the erected configuration. The middle panels 224 can be substantially perpendicular to the main panels 114*a,b* and substantially parallel to the side panels 116*a,b* when the box 100 is in the erected configuration.

The articulation described above can occur automatically when the user reconfigures the box 100 from the collapsed configuration to the erected configuration.

As shown, the dividing portion 480 can define five cells 482 within the cavity 108 in the present aspect. In other aspects, the dividing portion 480 can define greater or fewer than five cells 482. A center cell 484 of the cells 482 can be twice as large as the surrounding cells, and the center cell 484 can be used to carry a larger bottle, such as a liquor bottle having a rectangular, elliptical, or oval cross-sectional shape, as is common with many cognac bottles, for example and without limitation. In other aspects, a separate divider panel can be placed within the center cell 484 to divide it into two cells. In some aspects, one or more of the dividing wings 218*a,b,c,d* can comprise a folding flap which can be folded outward from the remaining portion of the dividing wing 218*a,b,c,d* and into the center cell 484 to divide the center cell 484. For example and without limitation, a portion can be cutout from the middles panels 224 such that when the middle panels 224 are folded about the middle hinges 226 relative to the inner panels 228, the portion can remain coplanar with the respective inner panels 228 and extend into center cell 484 to partition the center cell 484 into two separate cells.

Figure 5:
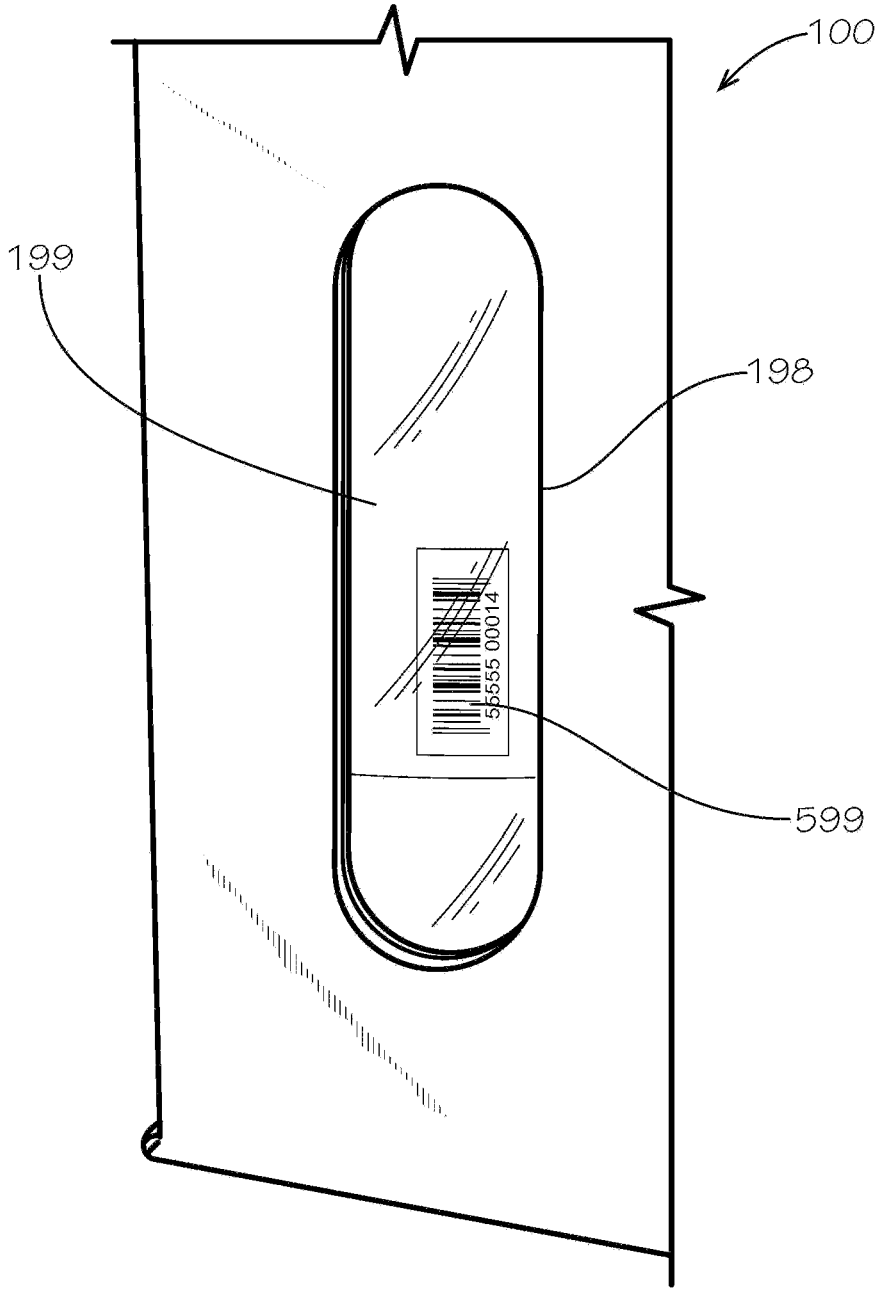
FIG. 5 is a perspective view of a viewing port defined by the box of FIG. 1 and a beverage container positioned within the box.

FIG. 5 is a perspective view of one of the viewing ports 198 of the box 100 of FIG. 1 demonstrating that the beverage container 199 can be seen through the viewing port 198. As shown, a barcode 599 on the beverage container 199 can be scanned through the viewing port 198 without removing the beverage container 199 from the box 100. The viewing ports 198 can also allow promotional material on the beverage containers 199, such as logos, to be viewed through the viewing ports 198.

Figure 6:
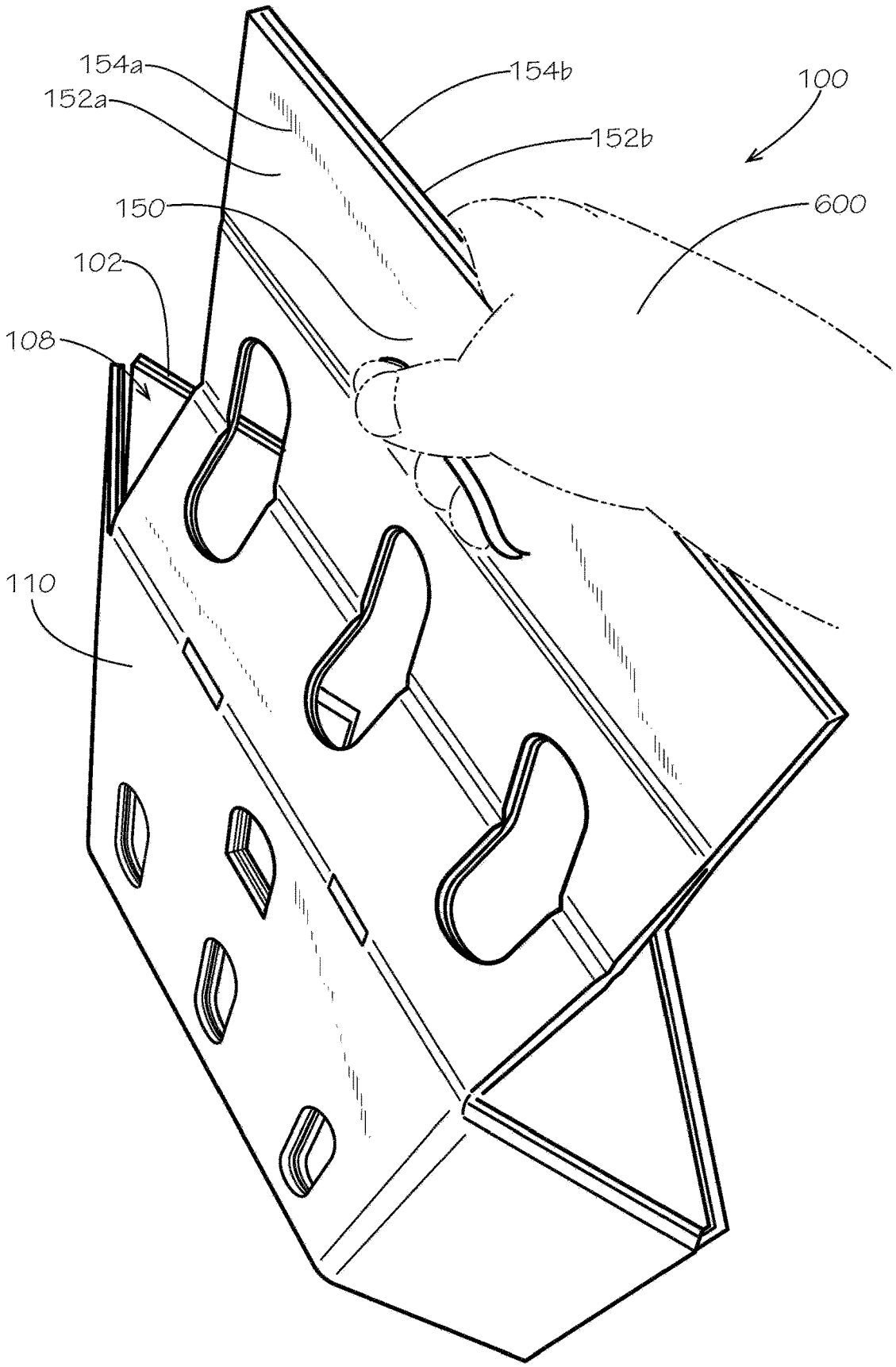
FIG. 6 is a perspective view of the box of FIG. 1 with the telescoping portion positioned in an extended configuration.
Figure 7:
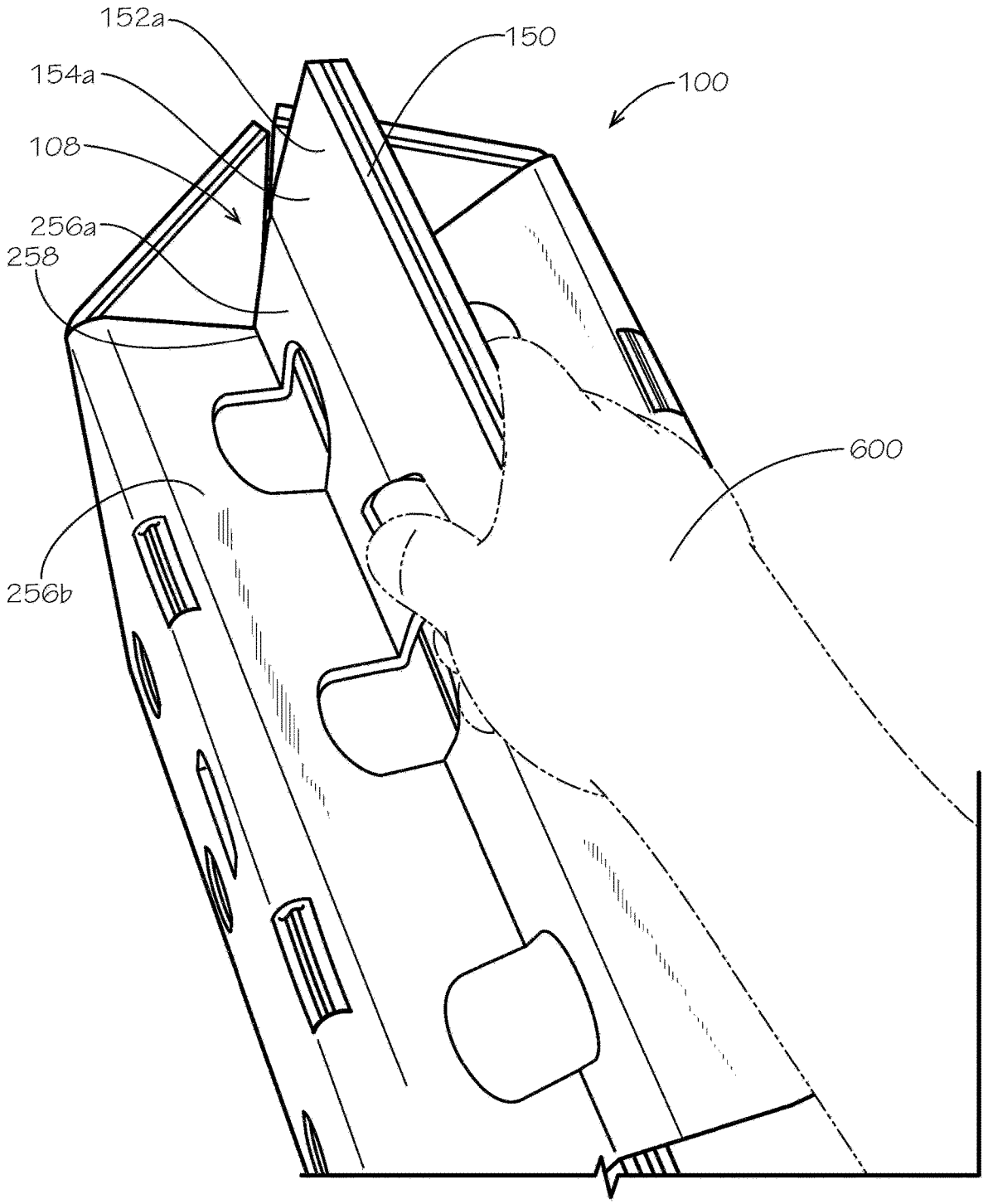
FIG. 7 is a perspective view of the box of FIG. 1 with the telescoping portion positioned in an intermediate configuration.
Figure 8:
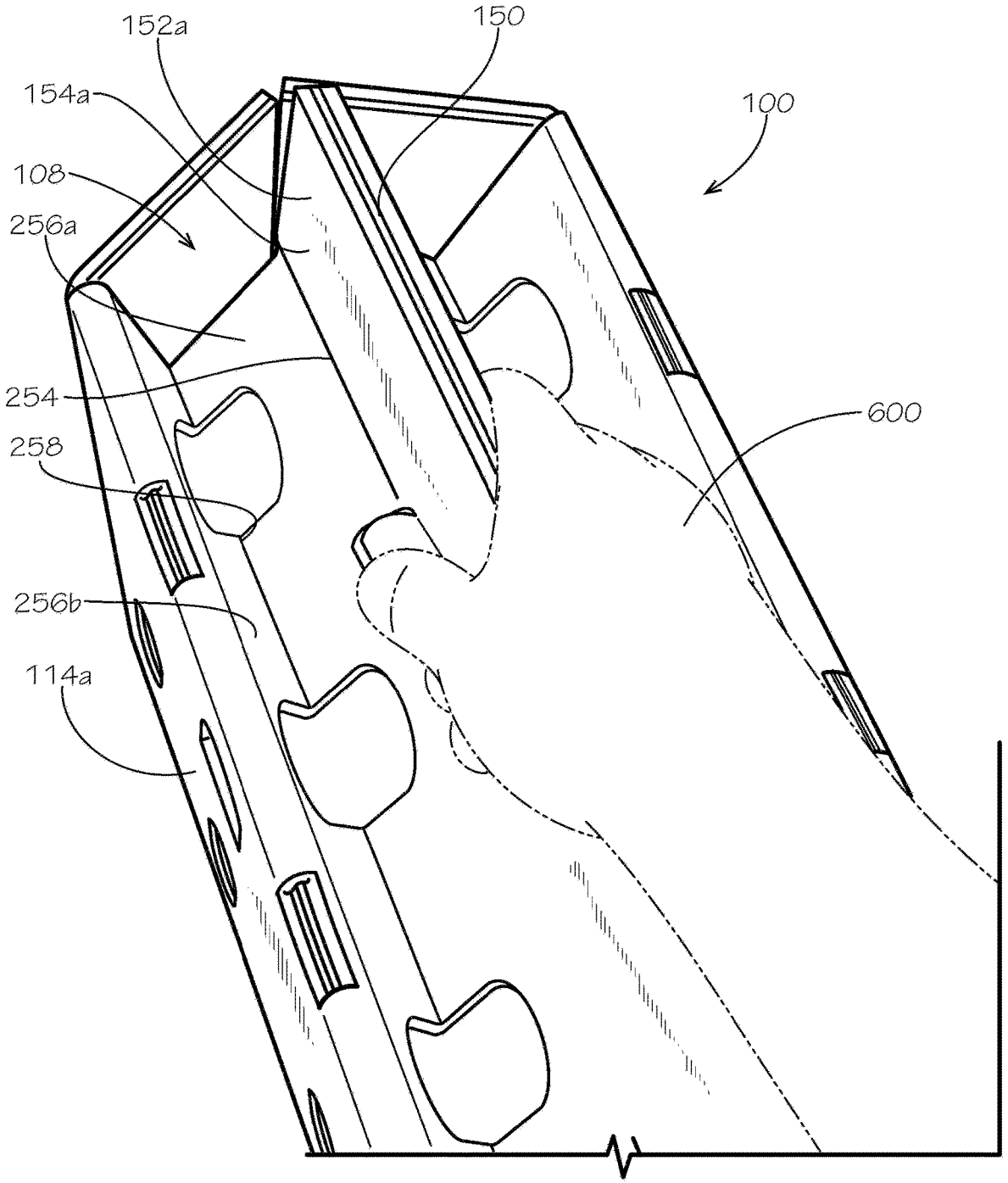
FIG. 8 is a perspective view of the box of FIG. 1 with the telescoping portion positioned in another intermediate configuration.
Figure 9:
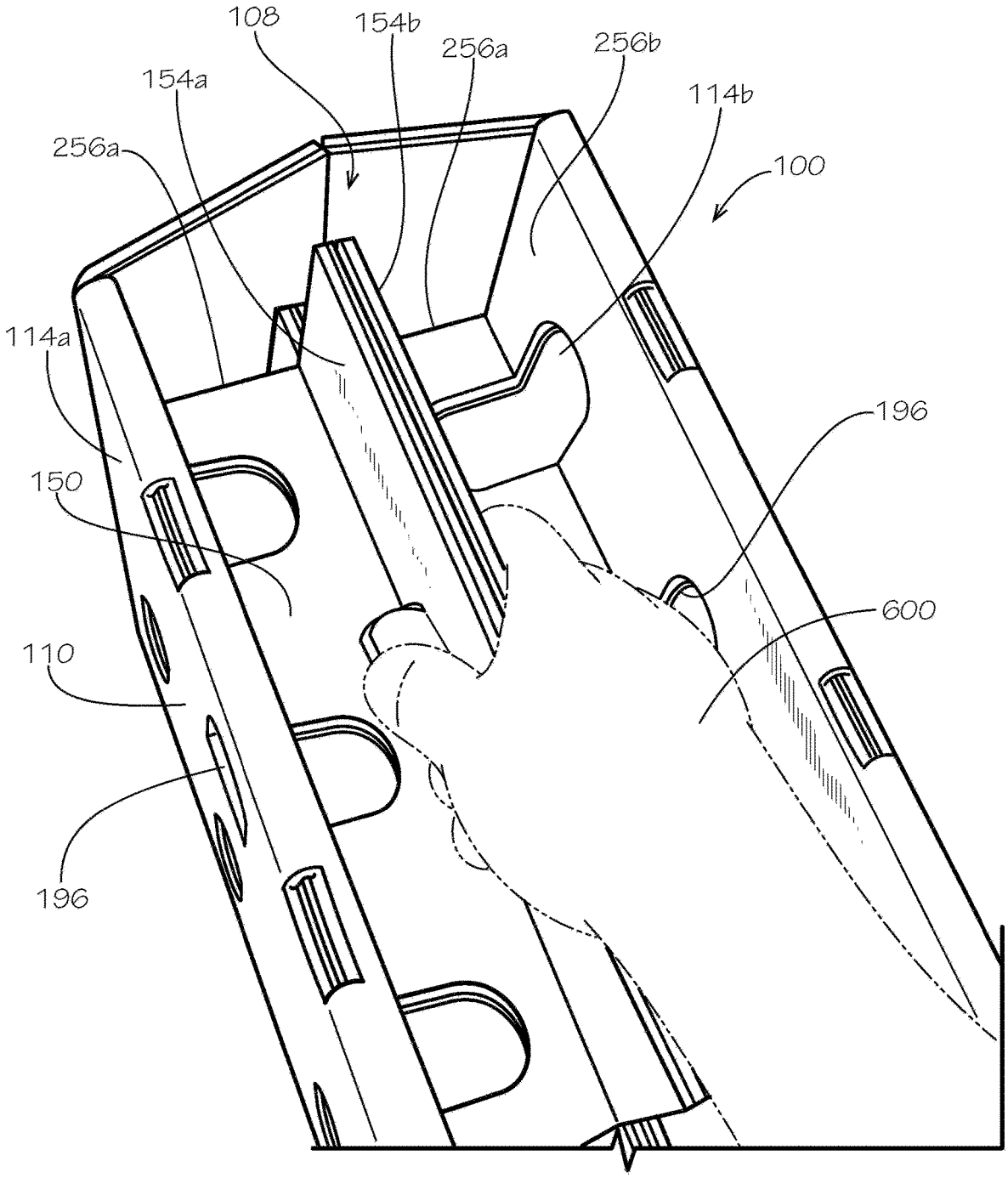
FIG. 9 is a perspective view of the box of FIG. 1 with the telescoping portion positioned in a retracted configuration.

As shown in FIGS. 6-9, the telescoping portion 150 can be selectively reconfigurable about and between the retracted configuration shown in FIG. 1 and FIG. 9, and an extended configuration shown in FIG. 6. A user 600 can reconfigure the telescoping portion 150 from the extended configuration to the retracted configured by placing the container portion 110 on a surface, grasping the handle portions 154*a,b* of the telescoping panels 152*a,b*, and pushing them downwards towards the container portion 110.

FIGS. 7-8 show intermediate steps in the reconfiguration of the telescoping portion 150 from the extended configuration to the retracted configuration.

In FIG. 7, telescoping panel 152*a* demonstrates that as the lower securing panel 256*b* begins to fold into the cavity 108, the upper securing panel 256*a* can be substantially parallel with the handle portion 154*a*. In this intermediate configuration, an acute angle can be formed between the lower securing panel 256*b* and the upper securing panel 256*a* about the securing hinge 258.

FIG. 8 shows that as the lower securing panel 256*b* folds further into the cavity 108 and begins to rotate towards the main panel 114*a*, the upper securing panel 256*a* begins to articulate relative to the handle portion 154*a* about the upper hinge 254.

FIG. 9 shows the telescoping portion 150 in the retracted configuration. In the retracted configuration, the lower securing panels 256*b* can be positioned within the cavity 108 in facing contact with the respective main panels 114*a,b*. The upper securing panels 256*a* can be positioned substantially perpendicular to both the lower securing panels 256*b* and the handle portions 154*a,b*. In some aspects, the handle portions 154*a,b* can be positioned entirely within the cavity 108 when the telescoping portion 150 is in the retracted configuration. In other aspects, the handle portions 154*a,b* may only be positioned partly within the cavity 108 when the telescoping portion 150 is in the retracted configuration.

In some aspects, adhesive can be applied between the lower securing panels 256*b* and the main panels 114*a,b* so that downward force on the container portion 110, such as from the weight of its contents, will not reconfigure the telescoping portion 150 from the retracted configuration to the extended configuration. In other aspects, the downward weight of contents within the container portion 110 can reconfigure the telescoping portion 150 from the retracted configuration to the extended configuration. The extended configuration can be a convenient configuration for a customer to carry beverage containers 199 (shown in FIG. 1) within the box 100, in part because the handle portions 154*a,b* can clear the necks 197 (shown in FIG. 1) of the beverage containers 199 (shown in FIG. 1), thereby preventing interference between the user's hand 600 and the beverage containers 199. The retracted configuration can be optimized for shipping. Alternatively, a customer can carry the box 100 in the retracted configuration by holding the carrying holes 196.

Figure 10:
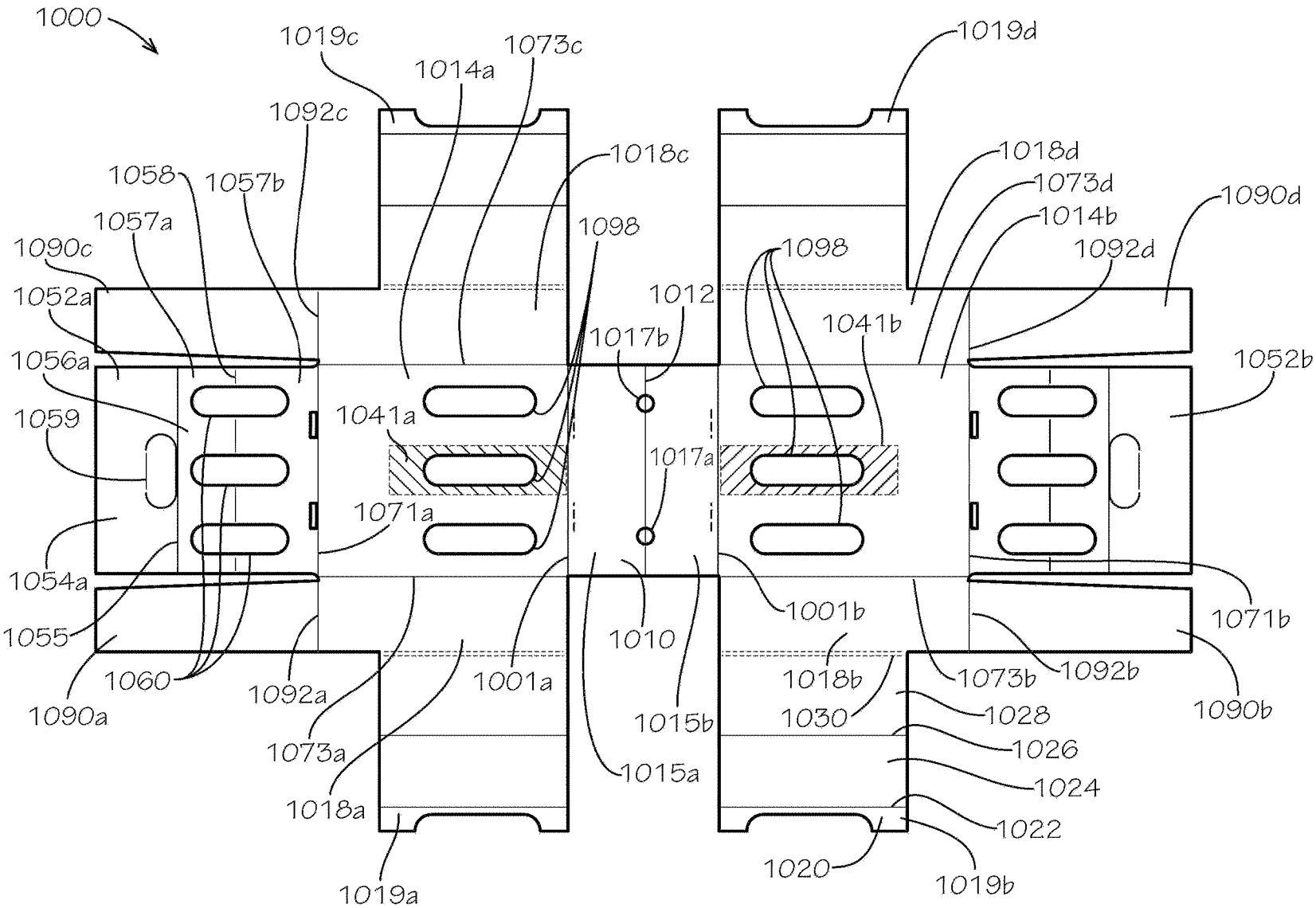
FIG. 10 is a plan view of another box blank in accordance with another aspect of the present disclosure.
Figure 11:
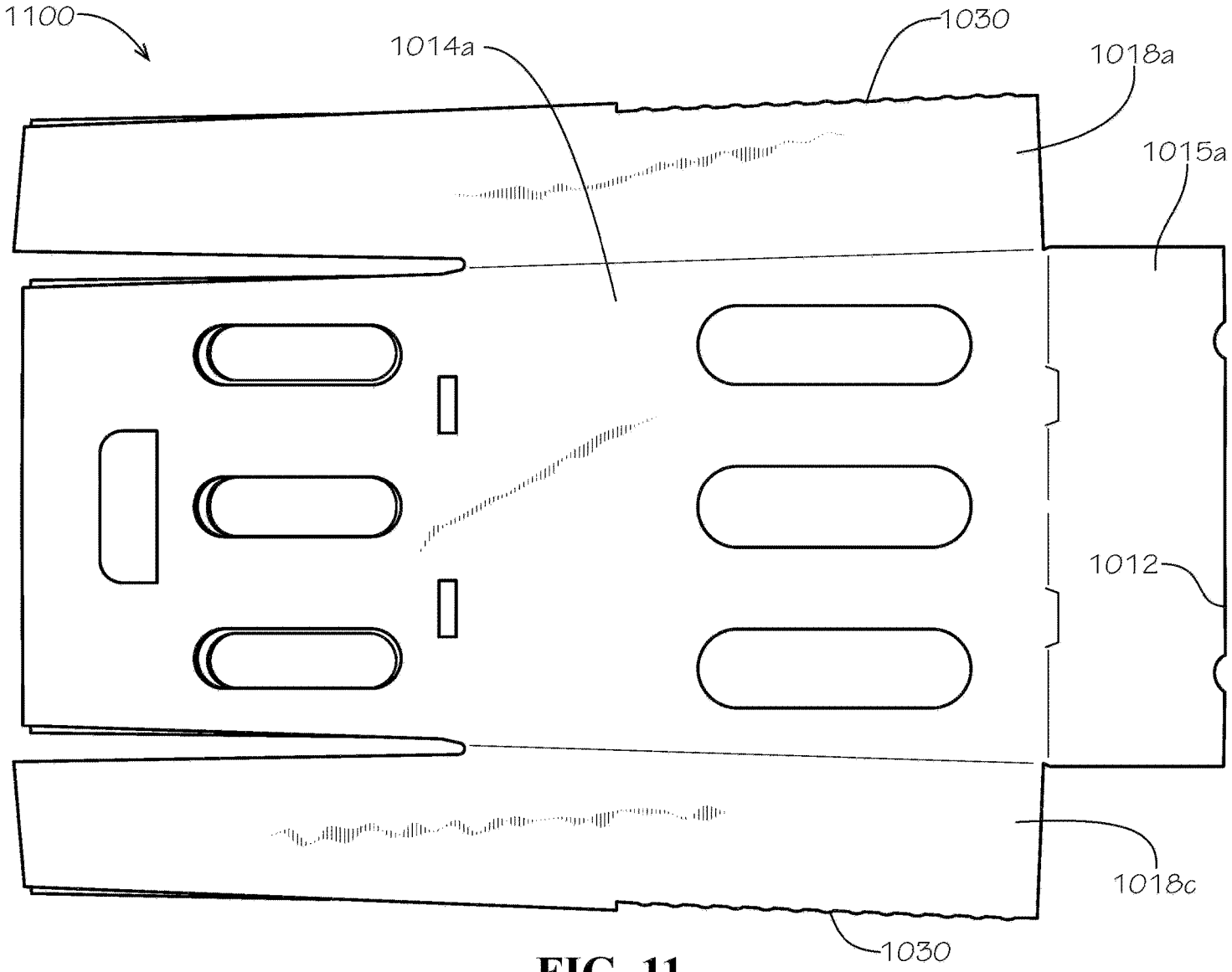
FIG. 11 is a front view of a box formed from the box blank of FIG. 10 in accordance with another aspect of the present disclosure, shown in a collapsed configuration.
Figure 12:
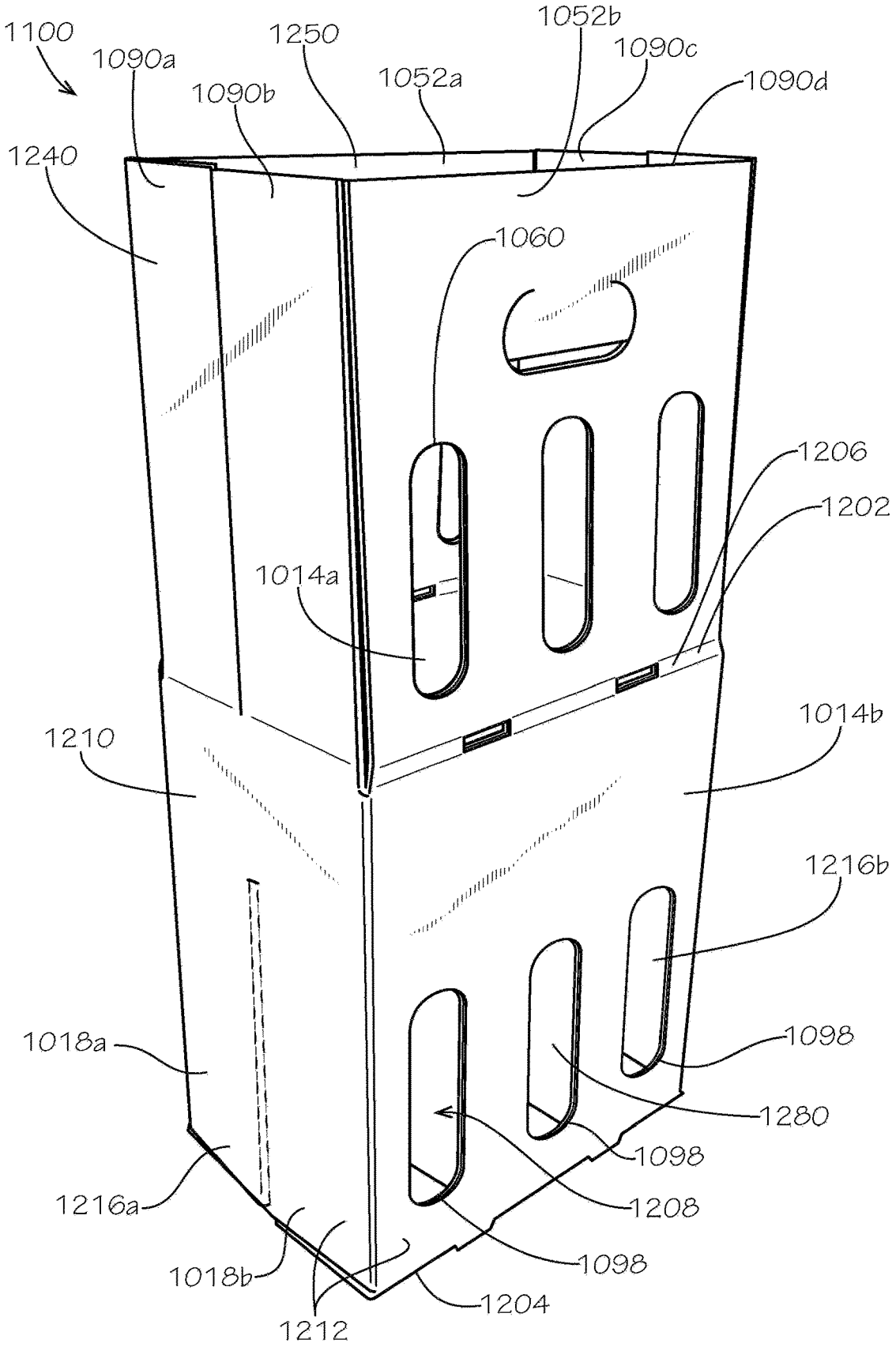
FIG. 12 is a rear perspective view of the box of FIG. 11 in an expanded configuration with a top portion of the box in an open configuration and a telescoping portion of the box in an extended configuration.

FIG. 10 is a plan view of a box blank 1000 that can be assembled to form a box 1100 (shown in FIG. 11 in an assembled and collapsed configuration; shown in FIG. 12 in an assembled and erected configuration).

The box blank 1000 can comprise a pair of bottom subpanels 1015*a,b* that can define a bottom panel 1010 of the box 1100 (shown in FIG. 11). The bottom subpanels 1015*a,b* can be hingedly attached together by a bottom hinge 1012. In the present aspect, the box blank 1000 can be symmetrical across the bottom hinge 1012. The bottom panel 1010 can define a plurality of holes 1017*a,b*, and the bottom hinge 1012 can intersect the holes 1017*a,b* in the present aspect. In other aspects, the bottom panel 1010 can define greater or fewer than two holes 1017*a,b*, and the bottom hinge 1012 can intersect all, some, or none of the holes 1017*a,b*.

The bottom subpanel 1015*a* can be hingedly coupled to a main panel 1014*a* of the box blank 1000 by a first main hinge 1001*a*, and the bottom subpanel 1015*b* can be hingedly coupled to a main panel 1014*b* of the box blank 1000 by a second main hinge 1001*b*. A telescoping panel 1052*a* can be hingedly coupled to the main panel 1014*a* opposite from the bottom panel 1010 by a first top hinge 1071*a*, and a telescoping panel 1052*b* can be hingedly coupled to the main panel 1014*b* opposite from the bottom panel 1010 by a second top hinge 1071*b*.

As demonstrated by telescoping panel 1052*a*, which can be representative of each telescoping panel 1052*a,b*, a handle portion 1054*a* of the telescoping panel 1052*a* can be defined by a single subpanel of the telescoping panel 1052*a*. The handle portion 1054*a* can be hingedly attached to a securing portion 1056*a* of the telescoping panel 1052*a* by an upper hinge 1055. The securing portion 1056*a* can be defined by an upper securing panel 1057*a* and a lower securing panel 1057*b*, which can be hingedly attached together by a securing hinge 1058. As shown, the telescoping panel 1052*a* can define a plurality of neck slots 1060 extending across both the upper securing panel 1057*a* and the lower securing panel 1057*b* in the present aspect. The handle portion 1054*a* can define a hand hole 1059, which can be defined adjacent to the upper hinge 1055 in the present aspect.

A pair of side subpanels 1018*a,c*, 1018*b,d* can be hingedly coupled to each main panel 1014*a,b*, respectively, by side hinges 1073*a,b,c,d*. A top flap 1090*a,b,c,d* can be coupled to each side subpanel 1018*a,b,c,d* by a top flap hinge 1092*a,b,c,d*, respectively. Each telescoping panel 1052*a,b* can be positioned between a pair of top flaps 1090*a,c*, 1090*b,d*.

A dividing wing 1019*a,b,c,d* can be hingedly attached to each of the side subpanels 1018*a,b,c,d*. Dividing wing 1019*b*, which can be representative of each of the dividing wings 1019*a,b,c,d*, is labelled to identify an outer panel 1020, an outer hinge 1022, a middle panel 1024, a middle hinge 1026, an inner panel 1028, and an inner hinge 1030. The outer hinge 1022 can hingedly attach the outer panel 1020 to the middle panel 1024. The middle hinge 1026 can hingedly attach the middle panel 1024 to the inner panel 1028. The inner hinge 1030 can hingedly attach the inner panel 1028 to the respective side subpanel 1018*a,b,c,d*, which can be side subpanel 1018*b* for dividing wing 1019*b*.

The main panels 1014*a,b* can respectively define viewing ports 1098. The main panels 1014*a,b* can each respectively define an adhesive zone 1041*a,b*. In the present aspect, the adhesive zones 1041*a,b* can be defined around each middle viewing port 1098 of the respective main panel 1014*a,b*.

In order to assemble the box blank 1000 to the box 1100 in the assembled and collapsed configuration shown in FIG. 11, the dividing wings 1019*a,b,c,d*, can be folded about the inner hinges 1030, and the outer panels 1020 can be coupled to the adhesive zones 1041*a,b*, such as with an adhesive, tape, or any other suitable means, including staples, rivets, stitches, or other means, as similarly discussed with respect to FIG. 3A. The outer panels 1020 can be shaped complimentary to the middle viewing ports 1098 so that the outer panels 1020 do not occlude the middle viewing ports 1098 when coupled to the respective adhesive zones 1041*a,b*. Next, the box blank 1000 can be folded in half about the bottom hinge 1012, and the inner panels 1028 of opposite pairs of dividing wings 1019*a,b,c,d* can be coupled together, such as with an adhesive, tape, or any other suitable means, including staples, rivets, stitches, or other means, as similarly discussed with respect to FIG. 3B. For example, the inner panel 1028 of dividing wing 1019*a* can be coupled to the inner panel 1028 of dividing wing 1019*b*.

FIG. 11 is a front view of the box 1100 formed from the box blank 1000 of FIG. 10, shown in the assembled and collapsed configuration. To erect the box 1100 to the assembled and erected configuration shown in FIG. 12, a user can press the bottom hinge 1012 towards the main panels 1014*a,b* (main panel 1014*b* shown in FIG. 10) until the bottom subpanels 1015*a,b*, (bottom subpanel 1015*b* shown in FIG. 10) are substantially parallel and coplanar with one another. Alternatively, a user can press the inner hinges 1030 inwards towards the main panels 1014*a,b* until the side subpanels 1018*a,b,c,d*, (side subpanels 1018*b,d* shown in FIG. 10) are substantially parallel with one another, and adjacent pairs of side subpanels 1018*a,b*, 1018*c,d* are substantially coplanar with one another. Alternatively, a user can pull the main panels 1014*a,b* apart from one another to erect the box 1100.

FIG. 12 is a rear perspective view of the box 1100 of FIG. 11 in the erected configuration. The box 1100 can comprise a container portion 1210, a telescoping portion 1250, a dividing portion 1280 (visible through viewing ports 1098), and a top portion 1240.

Figure 13:
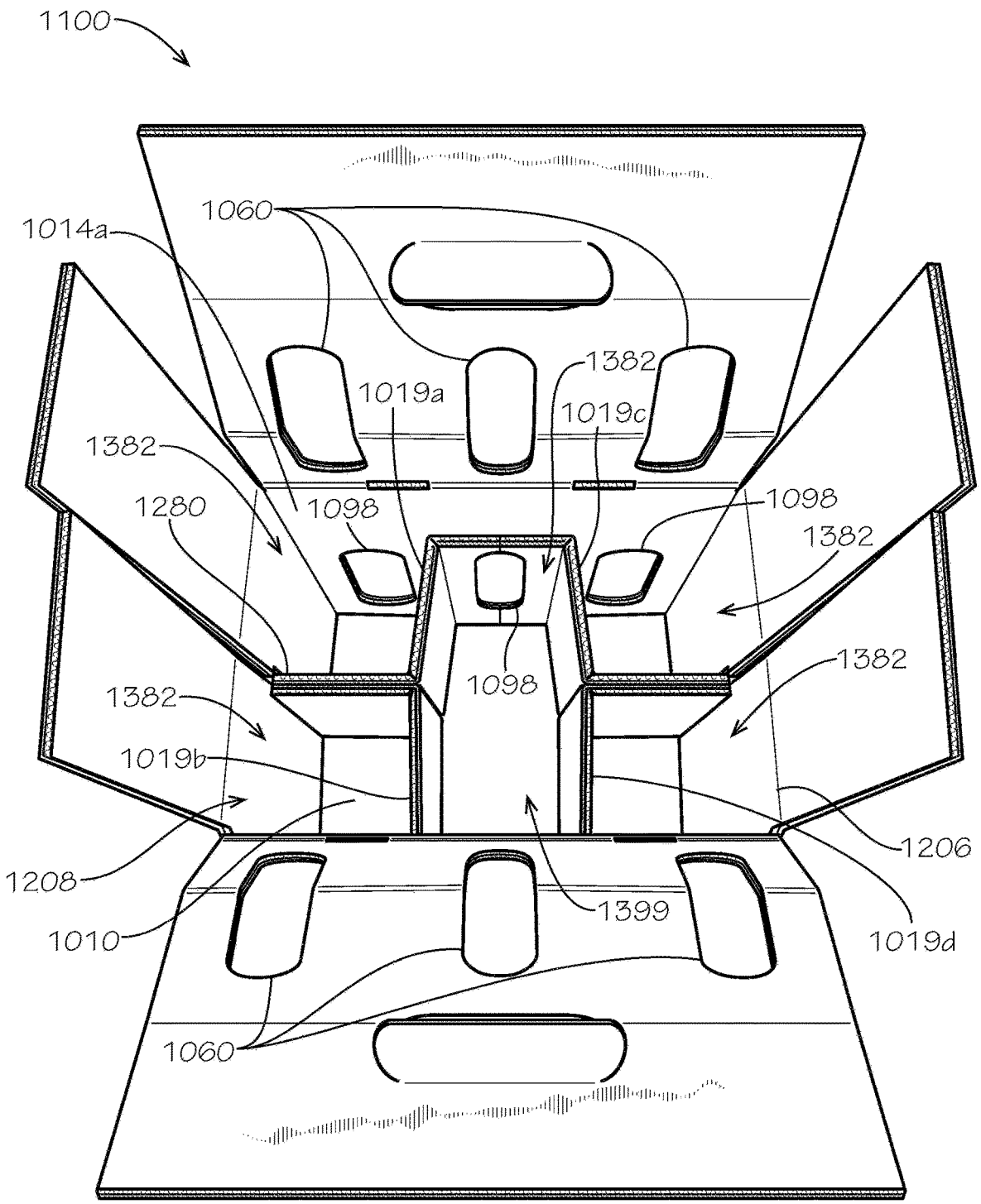
FIG. 13 is a top perspective view of the box of FIG. 11 in the expanded configuration with the top portion in the open configuration and the telescoping portion in the extended configuration.

The container portion 1210 can comprise a plurality of side walls 1212 and the bottom panel 1010 (shown in FIG. 13). The plurality of side walls 1212 can comprise the pair of opposing main panels 1014*a,b* (main panel 1014*a* visible through neck slot 1060), and a pair of opposing side panels 1216*a,b* (side panel 1216*b* visible through viewing port 1098). Each of the opposing main panels 1014*a,b* can be oriented substantially perpendicular to each of the opposing side panels 1216*a,b*. Each of the side panels 1216*a,b* can be defined by a different pair of side subpanels 1018*a,b*, 1018*c,d*, respectively (side subpanels 1018*c,d* shown in FIG. 10). Each pair of side subpanels 1018*a,b*, 1018*c,d* can be coupled together to define the respective side panels 1216*a,b*.

The container portion 1210 can define a top end 1202 and a bottom end 1204, disposed opposite from the top end 1202. The bottom panel 1010 (shown in FIG. 13) can be positioned at the bottom end 1204. The container portion 1210 can define a cavity 1208 that is at least partially defined by the plurality of side walls 1212 and the bottom panel 1010 (shown in FIG. 13). The top end 1202 can define an opening 1206 to the cavity 1208, which is shown more clearly in FIGS. 16 and 17.

The top portion 1240 and the telescoping portion 1250 can be coupled to the top end 1202. The top portion 1240 can comprise the top flaps 1090*a,b,c,d*, which can be coupled to the respective side subpanels 1018*a,b,c,d* at the top end 1202. The top portion 1240 is shown in an open configuration, wherein the top portion 1240 does not cover the opening 1206.

The telescoping portion 1250 can comprise the pair of telescoping panels 1052*a,b*, which can each be hingedly coupled to a different one of the main panels 1014*a,b*. The telescoping portion 1250 is shown in an extended configuration wherein the telescoping panels 1052*a,b* are disposed external to the cavity 1208.

FIG. 13 is a top perspective view of the box 1100 of FIG. 11 in the erected configuration. The dividing portion 1280 can be positioned within the cavity 1208. The dividing portion 480 can comprise the dividing wings 1019*a,b,c,d*. In the present aspect, the dividing portion 1280 can be positioned below the opening 1206. The dividing portion 1280 can define a plurality of cells 1382 within the cavity 108. Each of the neck slots 160 and each of the viewing ports 1098 can align with a different cell 1382 of the plurality of cells 1382, with the exception of a center cell 1399. The center cell 1399 can be a double-wide cell in the present aspect, and one of the neck slots 160 and one of the viewing ports 1098 can be aligned with the center cell 1399 on each opposing side. In other aspects, the center cell 1399 can be divided into two separate cells 1382.

Figure 17:
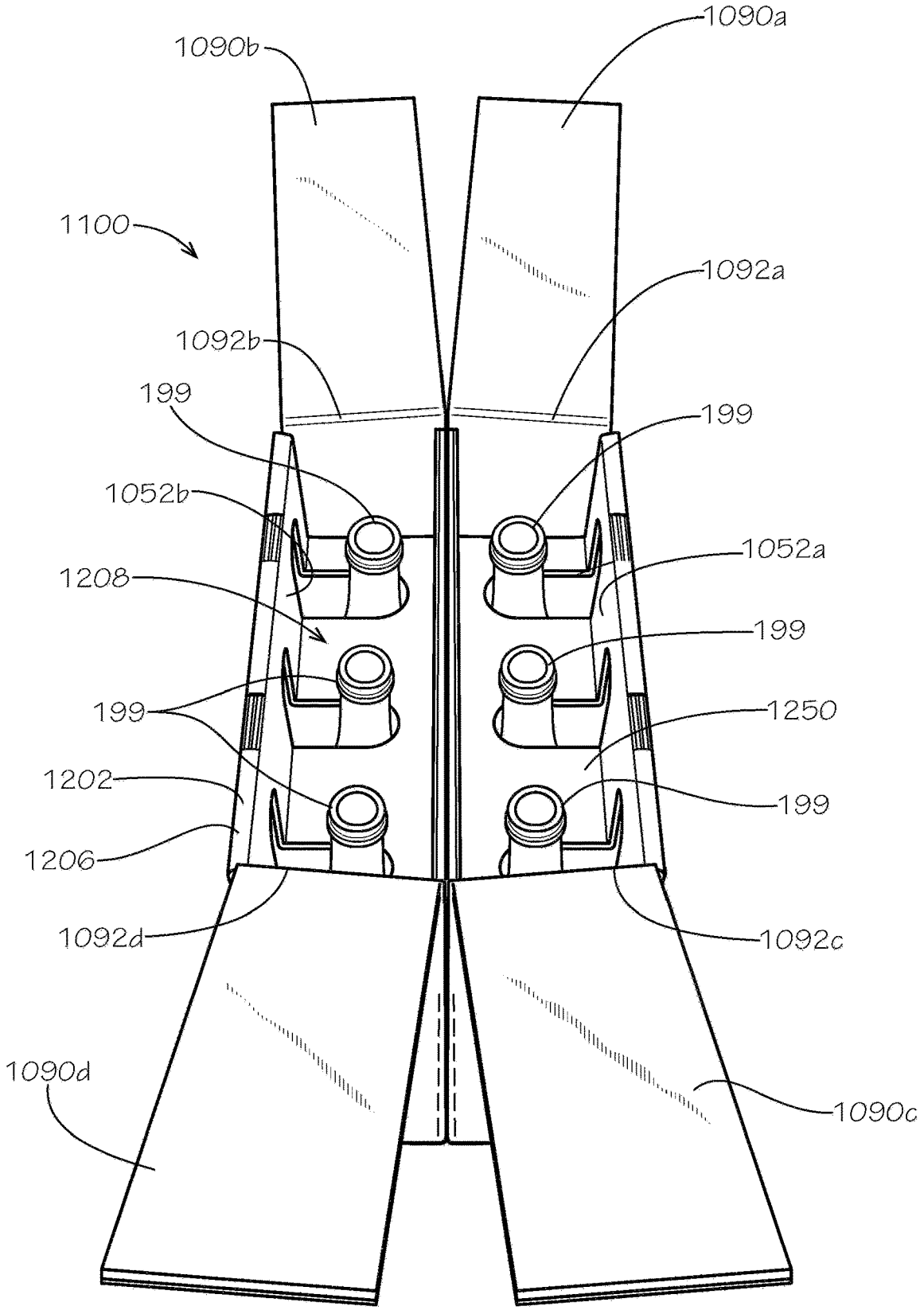
FIG. 17 is a perspective side view of the box of FIG. 11 in the expanded configuration with containers positioned within a cavity of the box, the top portion positioned in the open configuration, and the telescoping portion positioned in the retracted configuration.

As similarly discussed above with respect to the box 100 of FIG. 1, the cells 1382 can each be configured to receive a beverage container 199, or in the case of the center cell 1399, two beverage containers 199, as shown in FIG. 17.

Figure 14:
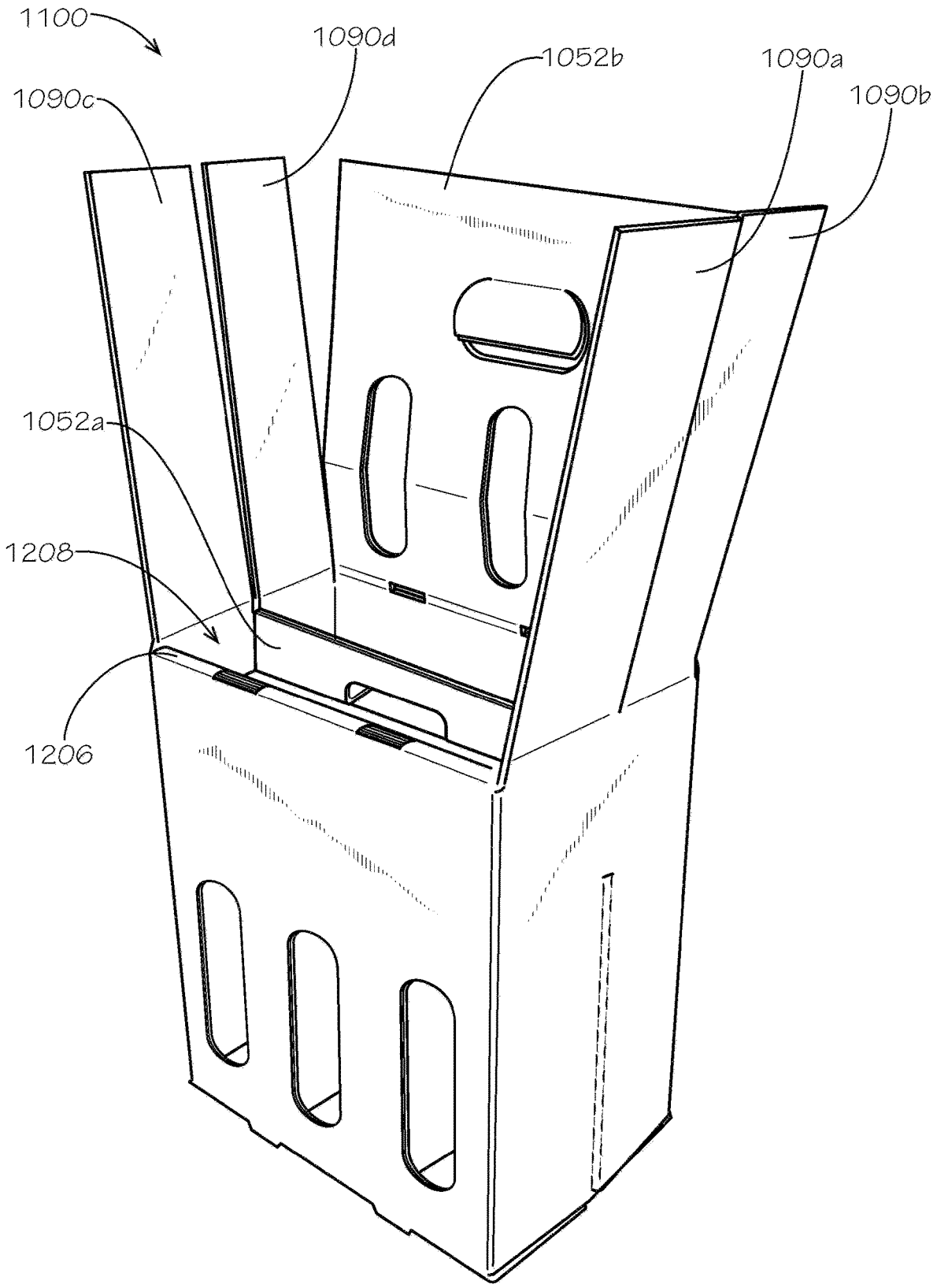
FIG. 14 is a front perspective view of the box of FIG. 11 in the expanded configuration with the top portion in the open configuration, a first telescoping panel of the telescoping portion in a retracted configuration, and a second telescoping panel of the telescoping portion in the extended configuration.
Figure 15:
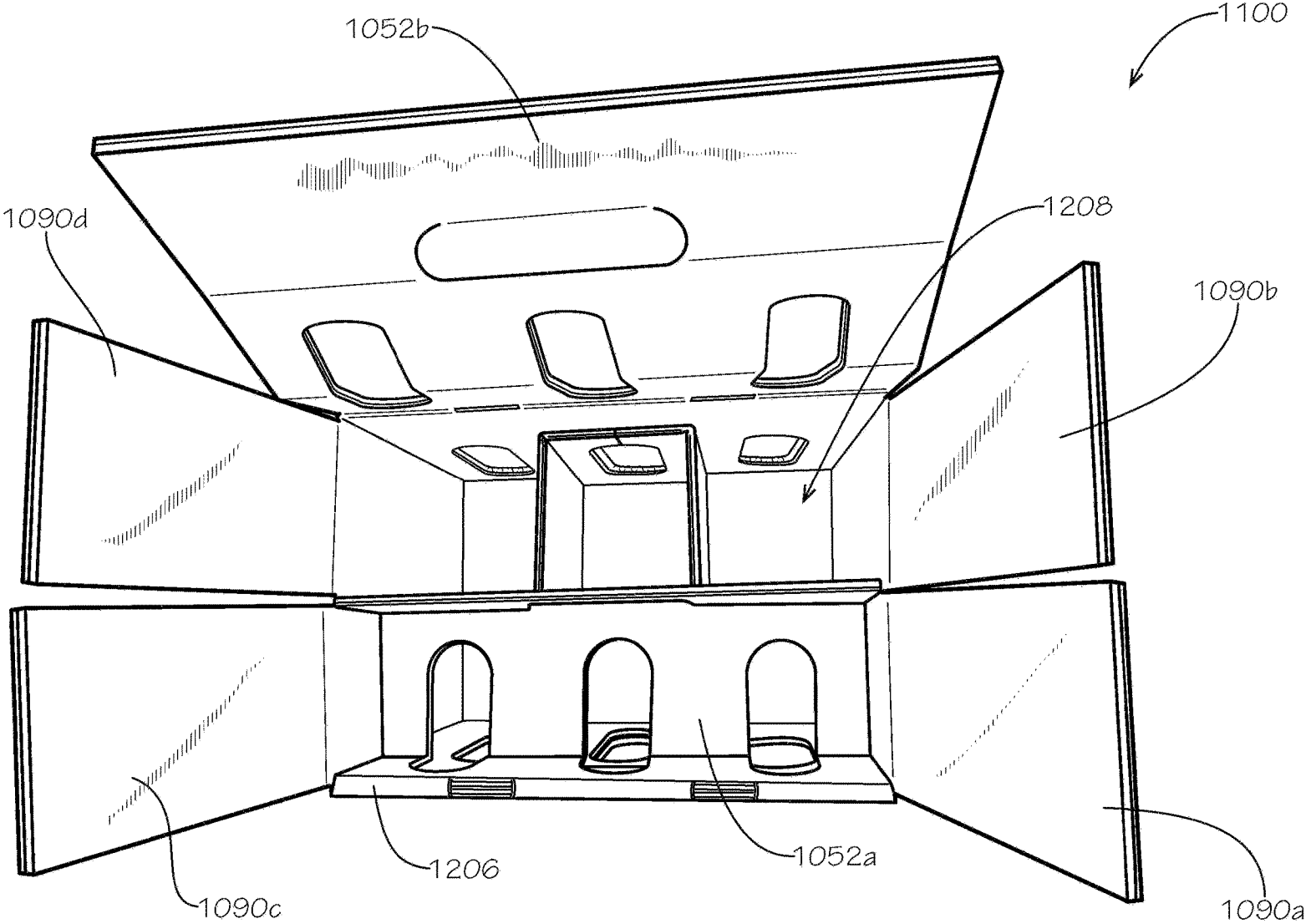
FIG. 15 is a top view of the box of FIG. 11 in the expanded configuration with the top portion in the open configuration, the first telescoping panel in the retracted configuration, and the second telescoping panel in the extended configuration.

FIG. 14 is a front perspective view of the box 1100 of FIG. 11 with one telescoping panel 1052*a* in the retracted configuration, one telescoping panel 1052*b* in the extended configuration, and all four top flaps 1090*a,b,c,d* in the open configuration. FIG. 15 is a top view of the box 1100 of FIG. 11 with one telescoping panel 1052*a* in the retracted configuration, one telescoping panel 1052*b* in the extended configuration, and all four top flaps 1090*a,b,c,d* in the open configuration. In the retracted configuration, as shown by telescoping panel 1052*a*, the telescoping panels 1052*a,b* can be at least partially positioned below the opening 1206 and within the cavity 1208. In the extended configuration, as shown by telescoping panel 1052*b*, no portion of the telescoping panels 1052*a,b* is positioned below the opening 1206 or within the cavity 1208.

Figure 16:
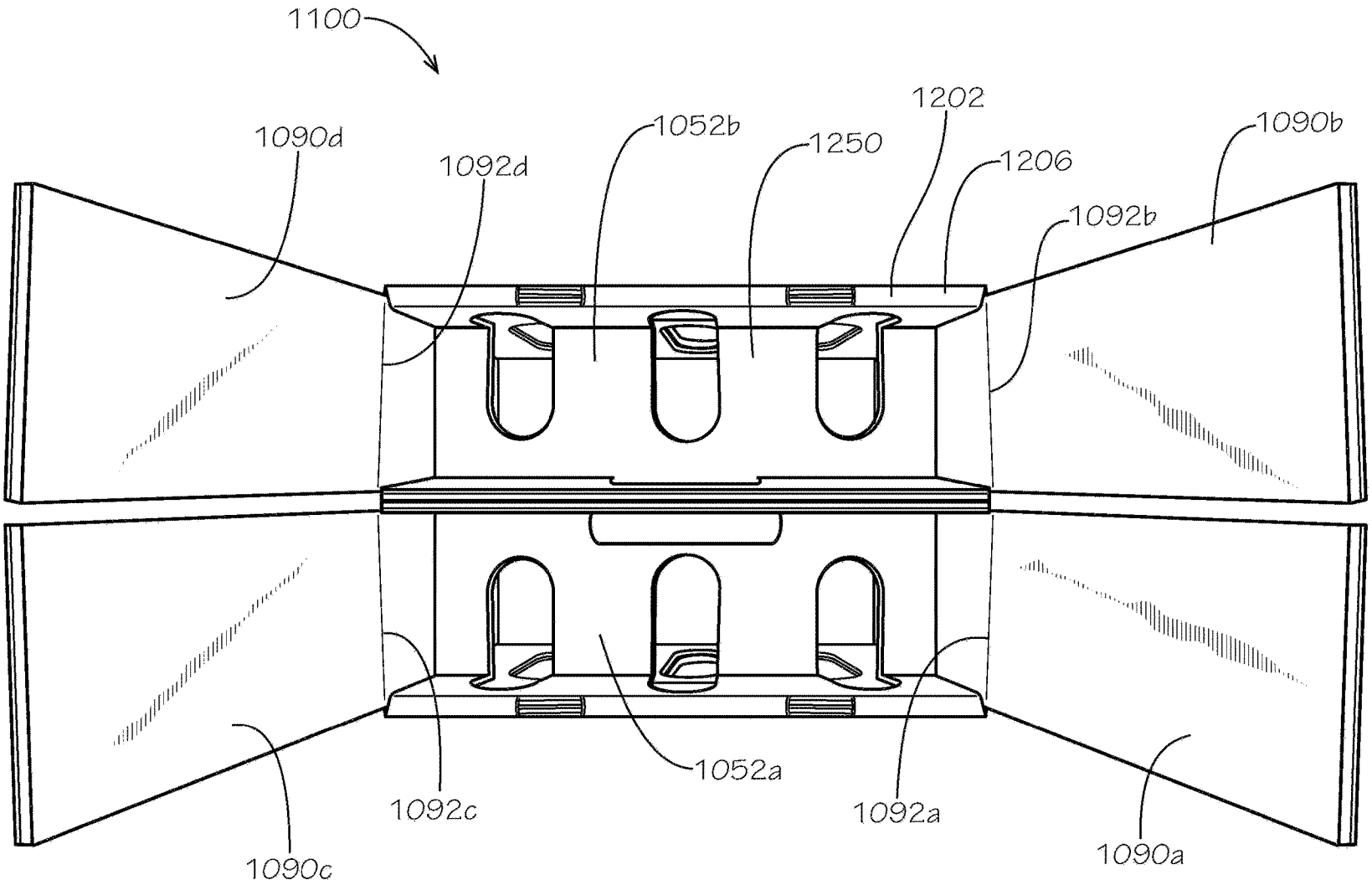
FIG. 16 is a top view of the box of FIG. 11 in the expanded configuration with the top portion in the open configuration and the telescoping portion in the retracted configuration.

FIG. 16 is a top view of the box 1100 of FIG. 11 with both telescoping panels 1052*a,b* in the retracted configuration and all four top flaps 1090*a,b,c,d* in the open configuration. FIG. 17 is a top perspective view of the box 1100 of FIG. 11 with both telescoping panels 1052*a,b*, in the retracted configuration, all four top flaps 1090*a,b,c,d*, in the open configuration, and six beverage containers 199 of FIG. 1 positioned within the cavity 1208.

With the telescoping portion 1250 positioned in the retracted configuration, the top flaps 1090*a,b,c,d* can be repositioned to a closed configuration (shown in FIG. 18) wherein the top flaps 1090*a,b,c,d* at least partially cover, or occlude, the opening 1206. The top flaps 1090*a,b,c,d* can be repositioned to the closed configuration by folding the top flaps 1090*a,b,c,d* about the respective top flap hinges 1092*a,b,c,d* so that opposing pairs of the top flaps 1090*a,c*, 1090*b,d* overlap one another, thereby at least partially enclosing the cavity 1208.

Figure 18:
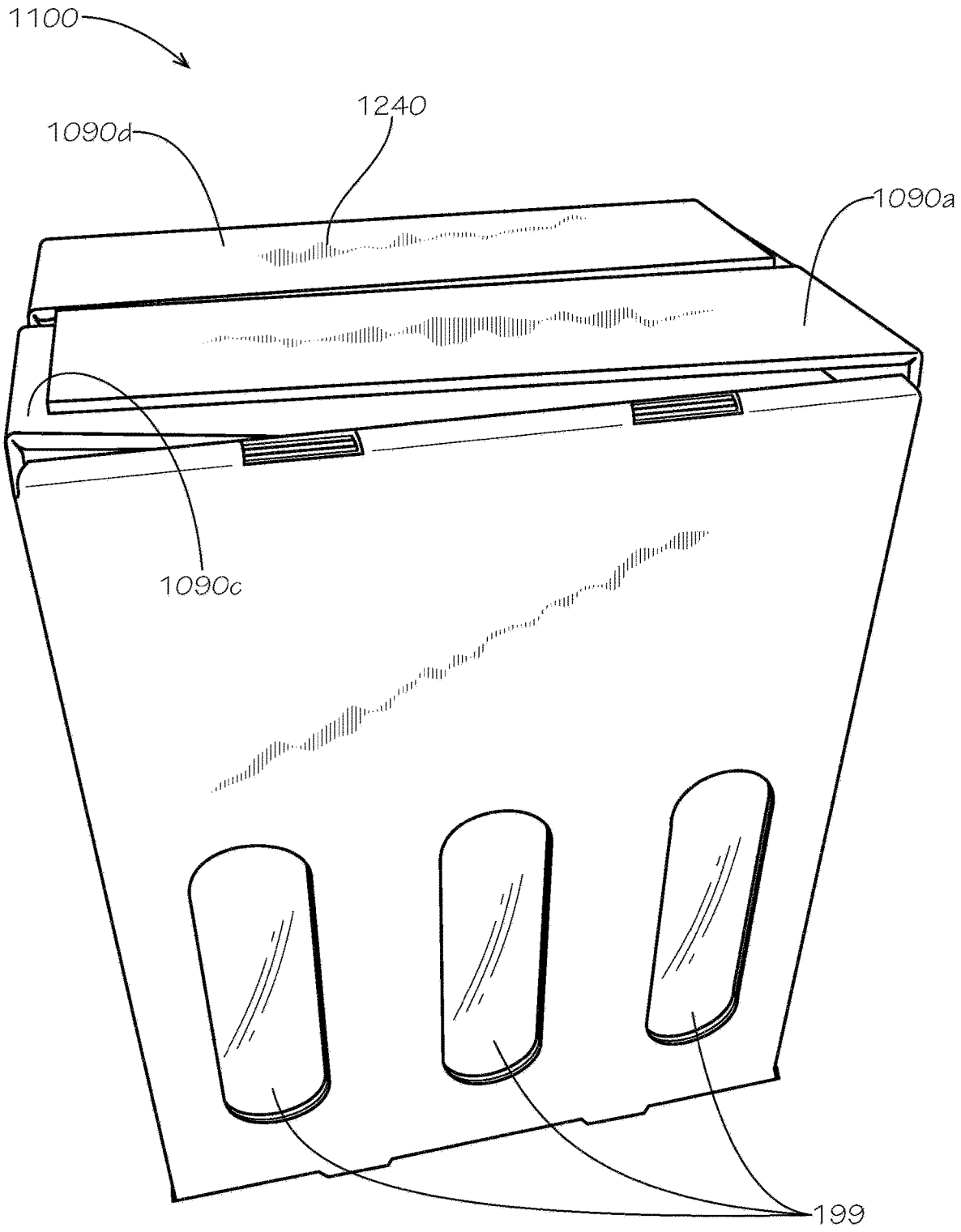
FIG. 18 is a front perspective view of the box of FIG. 11 in the expanded configuration enclosing the containers with the top portion in a closed configuration and the telescoping portion in the retracted configuration.

FIG. 18 is a front perspective view of the box 1100 of FIG. 11 with the top portion 1240 in the closed configuration. The top flaps 1090*a,b,c,d* (top flap 1090*b* shown in FIG. 17) can be secured in the closed configuration, such as with tape, an adhesive applied between overlapping pairs of top flaps 1090*a,c*, 1090*b,d*, staples, hook-and-loop fasteners, or any other suitable method. Closing the top flaps 1090*a,b,c,d* can protect the necks of the beverage containers 199, such as during shipping. The top flaps 1090*a,b,c,d* can also protect against inadvertent reconfiguration of the telescoping portion 1250 (shown in FIG. 17) from the retracted configuration to the extend configuration, which could allow the beverage containers 199 to fall out of the box 1100.

In the present aspect, the box 100,1100 (box 100 shown in FIG. 1) can comprise corrugated cardboard. In some aspects, the box 100,1100 can comprise double-walled corrugated cardboard, which can provide additional strength and protection to contents of the box 100,1100, as well as increased thermal insulation value. In some aspects, the corrugated cardboard can be insulated, or the box 100,1100 can be transported in an outer insulated box. In other aspects, the box 100,1100 can comprise a different material, such as plastic, metal, composite, or fiber-based material, for example and without limitation.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed:

1. A box comprising:

a container portion, the container portion defining a top end and a bottom end, the container portion defining a cavity;

a telescoping portion attached to the top end of the container portion, the telescoping portion selectively reconfigurable between a retracted configuration and an extended configuration, a portion of the telescoping portion being positioned within the cavity in the retracted configuration, the telescoping portion disposed external to the cavity in the extended configuration; and a dividing portion disposed within the cavity, the dividing portion defining a plurality of cells within the cavity; and wherein:

the container portion comprises a main panel and a side panel;

the side panel comprises a first side subpanel and a second side subpanel;

the first side subpanel is hingedly coupled to the main panel;

the dividing portion comprises a first dividing wing and a second dividing wing;

the first dividing wing is hingedly coupled to the first side subpanel; and the second dividing wing is hingedly coupled to the second side subpanel.

2. The box of claim 1, wherein the first dividing wing is attached to the second dividing wing to couple the first side subpanel to the second side subpanel.

3. The box of claim 1, wherein:

the first dividing wing comprises an inner panel, a middle panel, and an outer panel;

the inner panel is coupled to the second dividing wing;

the middle panel extends from the inner panel to the outer panel; and the outer panel is coupled to the main panel.

4. The box of claim 1, wherein:

a telescoping panel of the telescoping portion is coupled to the main panel of the container portion;

the main panel at least partially defines a first cell of the plurality of cells; and the telescoping panel defines a neck slot configured to align with the first cell when the telescoping panel is in the retracted configuration.

5. The box of claim 1, further comprising a top portion configured to at least partially enclose the cavity when the top portion is in a closed configuration.

6. The box of claim 1, wherein:

the container portion comprises the main panel;

the main panel at least partially defines an opening to the cavity at a top end of the container portion;

a telescoping panel comprises an upper securing panel and a lower securing panel;

the lower securing panel is coupled to the main panel at the top end;

the lower securing panel extends downwards into the cavity substantially parallel to the main panel in the retracted configuration; and the upper securing panel is positioned within the cavity substantially perpendicular to the lower securing panel in the retracted configuration.

7. A box blank comprising:

a bottom panel;

a main panel coupled to the bottom panel by a main hinge;

a telescoping panel coupled to the main panel by a top hinge positioned opposite from the main hinge;

a side subpanel coupled to the main panel by a side hinge; and a dividing wing coupled to the side subpanel opposite from the side hinge by an inner hinge, the inner hinge oriented parallel to the side hinge, the dividing wing configured to be folded about the inner hinge and coupled to the main panel to form a box.

8. The box blank of claim 7, wherein:

the side hinge is a first side hinge;

the side subpanel is a first side subpanel;

the box blank further comprises a second side subpanel;

the second side subpanel is coupled to the main panel opposite from the first side hinge by a second side hinge; and the dividing wing is configured to couple to a portion of the main panel that is substantially centered between the first side hinge and the second side hinge.

9. The box blank of claim 7, wherein:

the dividing wing is configured to form a cell between the dividing wing and the main panel when the dividing wing is coupled to the main panel; and the main panel defines a viewing port configured to align with the cell.

10. The box blank of claim 7, wherein:

the dividing wing is configured to form a cell between the dividing wing and the main panel when the dividing wing is coupled to the main panel; and the telescoping panel defines a slot configured to align with the cell.

11. The box blank of claim 7, wherein:

the dividing wing comprises an inner panel, a middle panel, and an outer panel;

the inner panel is coupled to the side subpanel by the inner hinge;

the middle panel is coupled to the inner panel by a middle hinge;

the outer panel is coupled to the middle panel by an outer hinge; and the outer panel is configured to couple to couple to the main panel to form the box.

12. The box blank of claim 11, wherein:

the main panel, the side subpanel, and the dividing wing are a first main panel, a first side subpanel, and a first dividing wing;

the main hinge, the side hinge, and the inner hinge are a first main hinge, a first side hinge, and a first inner hinge;

the box blank further comprises a second main panel coupled the bottom panel by a second main hinge, a second side subpanel coupled to the second main panel by a second side hinge, and a second dividing wing coupled to the second side subpanel by a second inner hinge; and the inner panel is configured to attach to an inner panel of the second dividing wing to couple the first side subpanel to the second side subpanel when the outer panel is coupled to the first main panel.

13. The box blank of claim 7, wherein a top flap is coupled to the side subpanel.

14. A box comprising:

a container portion comprising a main panel, the container portion defining a top end and a bottom end, the container portion defining a cavity, the main panel at least partially defining an opening to the cavity at the top end of the container portion;

a telescoping portion attached to the top end of the container portion, a telescoping panel of the telescoping portion comprising an upper securing panel and a lower securing panel, the lower securing panel coupled to the main panel at the top end, the telescoping portion selectively reconfigurable between a retracted configuration and an extended configuration, a portion of the telescoping portion being positioned within the cavity in the retracted configuration, the lower securing panel extending downwards into the cavity substantially parallel to the main panel in the retracted configuration, the upper securing panel positioned within the cavity substantially perpendicular to the lower securing panel in the retracted configuration, the telescoping portion disposed external to the cavity in the extended configuration; and a dividing portion disposed within the cavity, the dividing portion defining a plurality of cells within the cavity.

15. The box of claim 14, wherein:

the container portion comprises a main panel and a side panel;

the side panel comprises a first side subpanel and a second side subpanel;

the first side subpanel is hingedly coupled to the main panel;

the dividing portion comprises a first dividing wing and a second dividing wing;

the first dividing wing is coupled to the first side subpanel; and the second dividing wing is coupled to the second side subpanel.

16. The box of claim 15, wherein:

the first dividing wing comprises an inner panel, a middle panel, and an outer panel;

the inner panel is coupled to the second dividing wing;

the middle panel extends from the inner panel to the outer panel; and the outer panel is coupled to the main panel.

17. A box blank comprising:

a bottom panel;

a main panel coupled to the bottom panel by a main hinge;

a telescoping panel coupled to the main panel by a top hinge positioned opposite from the main hinge;

a side subpanel coupled to the main panel by a side hinge;

a top flap coupled to the side subpanel; and a dividing wing coupled to the side subpanel opposite from the side hinge by an inner hinge, the dividing wing configured to be folded about the inner hinge and coupled to the main panel to form a box.

18. The box blank of claim 17, wherein:

the dividing wing comprises an inner panel, a middle panel, and an outer panel;

the inner panel is coupled to the side subpanel by the inner hinge;

the middle panel is coupled to the inner panel by a middle hinge;

the outer panel is coupled to the middle panel by an outer hinge; and the outer panel is configured to couple to couple to the main panel to form the box.

19. The box blank of claim 18, wherein:

the main panel, the side subpanel, and the dividing wing are a first main panel, a first side subpanel, and a first dividing wing;

the main hinge, the side hinge, and the inner hinge are a first main hinge, a first side hinge, and a first inner hinge;

the box blank further comprises a second main panel coupled the bottom panel by a second main hinge, a second side subpanel coupled to the second main panel by a second side hinge, and a second dividing wing coupled to the second side subpanel by a second inner hinge; and the inner panel is configured to attach to an inner panel of the second dividing wing to couple the first side subpanel to the second side subpanel when the outer panel is coupled to the first main panel.

* * * * *